US007991346B2

(12) United States Patent
Kida et al.

(10) Patent No.: US 7,991,346 B2
(45) Date of Patent: Aug. 2, 2011

(54) IMAGE RECORDING SYSTEM

(75) Inventors: Hiroshi Kida, Nara (JP); Kimihito Yamasaki, Nara (JP); Yuji Okamoto, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 1093 days.

(21) Appl. No.: 11/481,007

(22) Filed: Jul. 6, 2006

(65) Prior Publication Data

US 2007/0014609 A1 Jan. 18, 2007

(30) Foreign Application Priority Data

Jul. 8, 2005 (JP) ..... 2005-200576
Aug. 24, 2005 (JP) ..... 2005-243058
Sep. 5, 2005 (JP) ..... 2005-256724
Sep. 20, 2005 (JP) ..... 2005-272310
May 30, 2006 (JP) ..... 2006-150196

(51) Int. Cl.
*G03G 15/00* (2006.01)

(52) U.S. Cl. ..... 399/405; 399/110; 399/124; 399/397; 399/401; 399/407; 271/3.19; 271/289

(58) Field of Classification Search ..... 399/405, 399/110, 124, 397, 401, 407; 271/3.19, 289
See application file for complete search history.

(56) References Cited

U.S. PATENT DOCUMENTS 5,150,167 A 9/1992 Gonda et al.
6,363,231 B1 * 3/2002 Manzer et al. ..... 399/82
6,608,988 B2 * 8/2003 Conrow ..... 399/364
6,925,283 B1 * 8/2005 Mandel et al. ..... 399/388
2003/0116911 A1 * 6/2003 Kanai ..... 271/303
2005/0082734 A1 * 4/2005 Goto et al. ..... 271/1
2005/0127598 A1 * 6/2005 Nagura ..... 271/264
2006/0039727 A1 * 2/2006 Lofthus et al. ..... 399/381

FOREIGN PATENT DOCUMENTS

JP 8-305221 A 11/1996
JP 10-86455 A 4/1998
JP 2004-93988 A 3/2004

* cited by examiner

*Primary Examiner* — Daniel J Colilla
*Assistant Examiner* — Andy L Pham
(74) *Attorney, Agent, or Firm* — Birch, Stewart, Kolasch & Birch, LLP

(57) ABSTRACT

An image recording system is configured in which a plurality of image recording apparatuses provided with a recording medium storage portion are disposed in a line, and a recording medium storage means shared by these image recording apparatuses is provided, and a recording medium that has been recorded by the plurality of image recording apparatuses is transported toward the recording medium storage means and stored in the recording medium storage means.

22 Claims, 12 Drawing Sheets

IMAGE RECORDING SYSTEM

BACKGROUND OF THE INVENTION

This application claims priority under 35 U.S.C. §119(a) on Patent Application No. 2005-200576 filed in Japan on Jul. 8, 2005, Patent Application No. 2005-243058 filed in Japan on Aug. 24, 2005, Patent Application No. 2005-256724 filed in Japan on Sep. 5, 2005, Patent Application No. 2005-272310 filed in Japan on Sep. 20, 2005, and Patent Application No. 2006-150196 filed in Japan on May 30, 2006 the entire contents of which are hereby incorporated by reference.

The present invention relates to an image recording system in which a plurality of image recording apparatuses are used.

At present, copy machines, faxes, print apparatuses, and the like are absolutely necessary for clerical work in offices, and these copy machines, faxes, print apparatuses and the like are configured based on an image recording apparatus. Recently, attention is focused on an image recording apparatus as a compound machine that incorporates all of the functions of these copy machines, faxes, print apparatuses and the like. As its main function, this image recording apparatus is provided with a function to record an image of characters, figures, or the like on a recording medium such as sheet-like recording paper. Also, recording of this image includes recording of a monochrome image and recording of a color image.

Recently, due to an increase in the amount of clerical work, an improvement in the processing ability of the above image recording apparatus has been sought. As an improvement in the processing ability of the image recording apparatus, more specifically, an improvement in processing speed and an increase in the recording paper storage capacity are sought.

The image recording apparatus records an image on recording paper that is a recording medium, so an improvement in processing speed is an improvement in the speed with which an image is recorded on the recording paper and the recording paper is discharged. This processing speed is expressed by the number of sheets of recording paper recorded/discharged per unit time, so in the image recording apparatus, an improvement in the number of sheets of recording paper recorded/discharged per unit time is needed.

As a method for satisfying such a need for an improvement in the processing speed, other than a method that improves the processing speed of the image recording apparatus itself, a method is conceivable in which a plurality of portions that execute the recording function of the image recording apparatus are provided, and by using these simultaneously in parallel, an overall improvement in processing speed is achieved. Various proposals have been made for responding to the above requirement from this viewpoint (for example, see JP H8-305221A).

JP H8-305221A (hereinafter, referred to as Patent Document 1) relates to a color print apparatus. This color print apparatus is configured using a plurality of color image forming apparatuses. With this color print apparatus, by using this plurality of color image forming apparatuses simultaneously in parallel, an overall improvement in processing speed is achieved.

Specifically, in the above color print apparatus, a pair is formed by one image forming apparatus that records an image on recording paper, and one multiple sheet feed apparatus that stores the recording paper supplied to this image forming apparatus. The combination of this pair of the image forming apparatus and the multiple sheet feed apparatus is disposed in a multi-unit case. Also, a discharge apparatus that is shared by the combination of the image forming apparatus and the multiple sheet feed apparatus is also disposed in the case.

That is, without including the multiple sheet feed apparatus in the above image forming apparatus, one image forming apparatus and one multiple sheet feed apparatus are combined, only the number of color print apparatuses (for example, two) necessary for this combination are disposed in the case, and a recording paper transport path and discharge apparatus suitable for the number of apparatuses in this combination are provided, thus configuring the color print apparatuses.

In the color print apparatuses of above Patent Document 1, when only one image forming apparatus is sufficient for processing ability, a color printing apparatus may be formed that has been configured with only this one image forming apparatus. However, even when attempting to form a color printing apparatus configured with a plurality of the above image forming apparatuses, for example two image forming apparatuses, using a color print apparatus that has been configured with only one image forming apparatus that differs from above Patent Document 1, it is difficult to form a color printing apparatus by simply combining two of the color print apparatuses that have been configured with only one of this image forming apparatus.

That is, with the color print apparatus disclosed in Patent Document 1, as described above, inside the case of the color print apparatus, a combination of only the necessary number of image forming apparatuses and multiple sheet feed apparatuses is disposed, and recording paper transport paths suitable for the number of apparatuses in this combination are provided, thus configuring the color print apparatuses. In an apparatus that uses two image forming apparatuses in this manner, reconfiguration is necessary, including the case and the post-recording transport path.

Also, with the color print apparatus disclosed in Patent Document 1, a pair is formed by one image forming apparatus and one multiple sheet feed apparatus that stores the recording paper supplied to this image forming apparatus, while on the other hand, with a color print apparatus in which one image forming apparatus is provided, only one multiple sheet feed apparatus can be used. Thus, with a color print apparatus in which one image forming apparatus is provided, it is difficult to handle in increase in the amount of recording paper.

Incidentally, in recent color and monochrome image recording apparatuses, as an image forming unit, ordinarily only one color or monochrome image forming unit is provided, but often a plurality of recording paper storage trays are included as recording paper storage trays. With this sort of image recording apparatus, a recording media storage tray or a recording media storage apparatus for storing recorded recording paper that is discharged from the image forming unit is attached, and independently used as a stand-alone device.

Accordingly, if a plurality of independent devices that include a plurality of recording paper storage trays and can be independently used can be lined up and configured as a single system, an image recording system with high cost performance can be formed without separately developing a special large device.

SUMMARY OF THE INVENTION

The present invention was made in light of such circumstances, and it is an object thereof to provide an image recording system in which, using a plurality of image recording apparatuses that can be used independently as stand-alone devices, processing capacity can be improved, and that furthermore has high cost performance.

The image recording system of the present invention includes at least image recording apparatuses that record an image on a recording medium, and a recording medium storage means that stores a recording medium that has been recorded by the image recording apparatus, in which a plurality of the image recording apparatuses are disposed in a line, and the recording medium storage means is shared by the plurality of image recording apparatuses, and a recording medium that has been recorded by an image recording apparatus is discharged toward the recording medium storage means, and stored in the recording medium storage means.

The image recording apparatuses used in the image recording system of the present invention are apparatuses that are provided with a recording medium storage portion, take out a recording medium that has been stored in the recording medium storage portion and perform image recording, and discharge the recording medium for which recording is finished. Ordinarily, these image recording apparatuses are provided with a recording medium storage tray that stores the recording medium for which recording is finished and a recording medium storage means of, for example, a recording medium storage apparatus, but in the image recording system of the present invention, the above apparatus in a state in which this sort of recording medium storage means is not provided is referred to as an image recording apparatus.

The above image recording system is configured with a plurality of image recording apparatuses. Accordingly, it is possible to use a plurality of image recording apparatuses at the same time, and by using this plurality of image recording apparatuses at the same time, recording of recording paper and the number of sheets discharged per unit time in the image recording apparatuses can be improved overall, and it is possible to achieve an increase in overall processing speed.

In the above image recording system, it is preferable that the image recording apparatuses are provided with a plurality of recording medium storage portions. By adopting such a configuration, it is possible to achieve an increase in the amount of recording paper in the image recording apparatuses of the above image recording system.

Also, it is preferable to configure the above image recording system in the following manner. That is, the image recording apparatuses are disposed in a line in the direction from front to rear, and the recording medium storage means is provided at the head of the line. A bypass transport means is provided in at least one of the image recording apparatuses, and a recording medium that has been recorded by the image recording apparatus disposed to the rear of the image recording apparatus in which the bypass transport means has been provided is discharged toward the recording medium storage means via the bypass transport means, and stored in the recording medium storage means.

By adopting such a configuration, it is possible to configure a system in which, as an image recording system, a recording medium that has been recorded by the image recording apparatus disposed to the rear of the image recording apparatus in which the bypass transport means has been provided is discharged toward the recording medium storage means via the bypass transport means, and stored in the recording medium storage means.

Further, in the above image recording system, as names of the above image recording apparatuses disposed in a line from front to rear, the image recording apparatus positioned in front and adjacent front to rear is called a front apparatus, the image recording apparatus positioned to the rear and adjacent front to rear is called a rear apparatus, the lead front apparatus is called a lead apparatus, and the rearmost rear apparatus is called a tail apparatus. Also, when the image recording apparatuses excluding the above tail apparatus are called a main apparatus, specifically, it is preferable to configure the above image recording system in the following manner.

That is, the above image recording apparatuses disposed in a line from front to rear are configured by providing an apparatus discharge port that discharges a recording medium for which recording is finished toward the front. In the above main apparatus, the bypass transport means is provided. The bypass transport means includes a bypass front receiving port, a main transport path, a bypass discharge port, a bypass rear receiving port, and a bypass transport path.

Among these, the bypass front receiving port is joined to the apparatus discharge port of the main apparatus in which the bypass transport means has been installed and receives a recording medium that is discharged from the apparatus discharge port. The main transport path transports a recording medium that has been received in the bypass front receiving port toward the front. The bypass discharge port discharges a recording medium that has been transported in the main transport path toward the front. The bypass rear receiving port, when the rear apparatus of the main apparatus is the tail apparatus, is joined to the apparatus discharge port of the tail apparatus, and when not the tail apparatus, is joined to the bypass discharge port of the bypass transport means installed in the rear apparatus of the main apparatus, and receives a recording medium that has been discharged from the bypass discharge port or the apparatus discharge port of the tail apparatus. The bypass transport path transports a recording medium that has been received in the above bypass rear receiving port toward the front and merges with a midway portion of the main transport path.

Also, in the above image recording system, the recording medium storage means that is shared by each of the above plurality of image recording apparatuses is provided in the bypass discharge port of the bypass transport means provided in the lead apparatus.

The above image recording system configured with the above tail apparatus, main apparatus, bypass transport means, and recording medium storage means is formed by providing the bypass transport means in the main apparatus, and disposing the main apparatus provided with the bypass transport means together in a line with the tail apparatus, for example. Thus, if production is finished for an image forming apparatus formed by the tail apparatus and the main apparatus, by simply preparing the bypass transport means, it is possible to form an image recording system provided with a plurality of image recording apparatuses and a recording medium storage means, with a brief method such as later installing the bypass transport means in an image recording apparatus and installing each apparatus. Accordingly, the cost of the image recording system can be reduced.

Also, in an image forming system that has been formed in this manner, as described above, by using a plurality of image recording apparatuses at the same time, it is possible to improve the overall processing speed, and so an image recording system in which it is possible to improve processing speed can be formed with low cost, and an image recording system with high cost performance can be provided.

In the above image recording system, it is preferable that by providing the recording medium storage means that stores a recording medium discharged from the apparatus discharge port in the apparatus discharge port, an image recording apparatus that can be independently used as a stand-alone device is used as an image recording apparatus. Also, it is preferable that the bypass transport means can be installed in the main apparatus later. When it is possible for the bypass transport means to be installed in the main apparatus later, it is possible to install a bypass transport means that has been completed later in a main apparatus that has been completed as an image recording apparatus.

Because the image recording apparatuses and the main apparatus as described above can be used as constituent elements of the image recording system, the following sort of advantages are achieved. That is, an image recording apparatus used in the configuration of the above image recording system can be used independently as a stand-alone device by providing the recording medium storage means, and also, the bypass transport means can be installed in the main apparatus later. Accordingly, it is possible to configure the image recording system by installing the bypass transport means in the main apparatus later, by using an image recording apparatus in which the recording medium storage means has been removed from a stand-alone device that is already operating as an image recording apparatus provided with the recording medium storage means, an image recording apparatus that is a new product, or the like as the main apparatus. Accordingly, a stand-alone device that is already operating can be systemized as an image recording system, and it is possible to achieve an improvement in the properties of such a stand-alone device that is already operating with low cost.

Also, in the above image recording system, it is recommended that the bypass transport path of the bypass transport means is provided such that it crosses over the top of the main apparatus. In this case, it is preferable to adopt a configuration such that at least a portion can be opened upward. By adopting such a configuration, it is possible to easily perform maintenance of the bypass transport path or to deal with a jam of the recording medium that has occurred in the bypass transport path.

Also, in the above image recording system, it is preferable to adopt a configuration in which a top storage means, which branches from the bypass transport path and stores a recording medium that is discharged from the rear apparatus of the main apparatus and is transported by the bypass transport path of the bypass transport means installed in the main apparatus, is installed on top of the bypass transport means.

In an image recording system provided with this top storage means, a plurality of image recording jobs are processed in parallel by the plurality of image recording apparatuses provided in the image recording system, and in such a case, it is advantageous that recording media on which an image is recorded and that then are transported are stored distinguished by each job unit. Thus, with the above image recording system provided with the above sort of top storage means, other than the recording medium storage means provided in the bypass transport means of the lead apparatus, i.e., the image recording apparatus that is disposed in the lead, it is possible to use the above top storage means. Accordingly, it is possible to easily store recording media distinguished by each job unit.

Also, in the above image recording system, it is recommended that the bypass transport means controls transport such that a recording medium that is transported in the bypass transport path of the bypass transport means can be temporarily held in the bypass transport path.

This sort of transport control is recommended for the following reasons. That is, in the above image recording system, because a plurality of image recording apparatuses are provided, it is possible to process a single job by distributing that job to a plurality of image recording apparatuses. In such a case, it is advantageous that a recording medium that has been recorded by a plurality of image recording apparatuses and then discharged is stored in a recording medium storage means that is shared by the plurality of image recording apparatuses. Thus, in the above image recording system, a recording medium that has been recorded by a plurality of image recording apparatuses and then discharged is stored in the recording medium storage means provided in the bypass transport means of the lead apparatus, i.e., the image recording apparatus that is disposed in the lead.

In such a case, in order to smoothly store a recording medium that has been recorded by a plurality of image recording apparatuses and then discharged in one recording medium storage means that is shared by the plurality of image recording apparatuses, it is necessary to adopt a configuration in which recording media that are discharged from a plurality of image recording apparatuses do not collide. Accordingly, by adopting a configuration as described above, it is possible to control transport such that recording media that has been discharged from a plurality of image recording apparatuses do not collide, and it is possible to smoothly perform storage of recorded storage media for processing performed by distributing a single job to a plurality of image recording apparatuses.

Also, in the above image recording system, it is preferable that an image reading means is provided on top of the tail apparatus, i.e., the image recording apparatus disposed rearmost. By adopting such a configuration, it is possible to add an image reading function to the above image recording system, and high functionality of the image recording system can be achieved.

The above image recording system is configured with a plurality of image recording apparatuses, but when this plurality of image recording apparatuses is made to be two image recording apparatuses, it is possible to construct an image recording system with a simple configuration.

In this case, the above image recording system is configured by disposing two image recording apparatuses, namely the front apparatus and the rear apparatus, adjacently front to rear, and along with providing the recording medium storage means in the front of the front apparatus, providing the bypass transport means on top of the front apparatus such that the bypass transport means crosses over the top of the front apparatus. For an image recording system that has been configured in this manner, it is preferable to form a first maintenance space as described below.

That is, the image recording system in which the first maintenance space is formed has a configuration in which, in both the front apparatus and the rear apparatus, which are two image recording apparatuses that have been disposed adjacently front to rear, a discharge carry-out path that transports a recording medium that has been carried out from the carry-out port that has been provided in the rear of the recording medium storage portion that stores a recording medium, and a rear vertical transport path that is connected to the carry-out port path and transports a recording medium that has been transported through the carry-out port path upward, are provided in each rear portion of the front apparatus and the rear apparatus.

Also, the image recording system in which the first maintenance space is formed has a configuration in which, in both the front apparatus and the rear apparatus, an apparatus discharge port that discharges toward the front a recording medium that has been transported through a horizontal supply transport path continuing from the rear vertical transport path, then recorded in an image recording portion, and further transported toward the front through a horizontal discharge transport path, and a front vertical transport path that is a part of a transport path used when the recording medium that has been transported through the horizontal discharge transport path has its front and back reversed and then is returned to the horizontal supply transport path, are provided in each front portion of the front apparatus and the rear apparatus.

Accordingly, in the above image recording system that has been configured in this manner, the first maintenance space is formed in a portion below the bypass rear receiving port of the bypass transport means such that it is faced by both the rear vertical transport path of the front apparatus and the front vertical transport path of the rear apparatus.

According to the above image recording system, the first maintenance space, which is faced by both the rear vertical transport path of the front apparatus and the front vertical transport path of the rear apparatus, is formed in a portion below the bypass rear receiving port of the bypass transport means, and so the first maintenance space can be used as a space for dealing with both a jam of a recording medium that has occurred in the rear vertical transport path of the front apparatus and a jam of a recording medium that has occurred in the front vertical transport path of the rear apparatus.

It is preferable that the above image recording system is configured such that both the rear vertical transport path of the front apparatus and the front vertical transport path of the rear apparatus can be opened to the first maintenance space. Being able to open a transport path to the space means that in a transport path that transports a recording medium such as recording paper by sandwiching the front and back of the recording medium, the side that makes contact with the front face of the recording medium and the side that makes contact with the back face are separated, and either side can be moved into the space described above.

By adopting such a configuration, in the rear vertical transport path of the front apparatus and the front vertical transport path of the rear apparatus, the side that makes contact with the front face of the recording medium and the side that makes contact with the back face can be separated, and so a recording medium such as recording paper or the like that is jammed in these transport paths can easily be removed. Accordingly, it is possible to easily deal with a jam of a recording medium that has occurred in the rear vertical transport path of the front apparatus or the front vertical transport path of the rear apparatus.

Also, in the above image recording system, it is preferable to adopt a configuration in which a cover that can be opened and closed is provided on at least one of both side faces of the first maintenance space, and when the cover is opened, both the front apparatus and the rear apparatus stop operation.

By adopting such a configuration, when dealing with a jam or the like of a recording medium that has occurred in the rear vertical transport path of the front apparatus or the front vertical transport path of the rear apparatus, it is possible to reliably stop operation of the front apparatus and the rear apparatus. Accordingly, it is possible to safely deal with a jam or the like of a recording medium that has occurred in the rear vertical transport path of the front apparatus or the front vertical transport path of the rear apparatus.

Also, in the above image recording system, it is preferable that a second maintenance space, which is faced by the front vertical transport path of the front apparatus, is formed in a portion below the main transport path of the bypass transport means.

According to the above image recording system, the second maintenance space, which is faced by the front vertical transport path of the front apparatus, is formed in a portion below the main transport path of the bypass transport means, and so the second maintenance space can be used as a space for dealing with a jam of a recording medium that has occurred in the front vertical transport path of the rear apparatus.

Also, in the above image recording system, it is preferable to adopt a configuration in which the front vertical transport path of the front apparatus can be opened to the second maintenance space. By adopting such a configuration, in the front vertical transport path of the front apparatus, it is possible to separate the side that makes contact with the front face of a recording medium and the side that makes contact with the back face, and so a recording medium such as recording paper or the like that is jammed in these transport paths can easily be removed. Accordingly, it is possible to easily deal with a jam of a recording medium that has occurred in the front vertical transport path of the front apparatus.

Also, in the above image recording system, it is preferable to adopt a configuration in which a cover that can be opened and closed is provided on at least one of both side faces of the second maintenance space, and when the cover is opened, both the front apparatus and the rear apparatus stop operation.

By adopting such a configuration, when dealing with a jam or the like of a recording medium that has occurred in the front vertical transport path of the front apparatus, it is possible to reliably stop operation of the front apparatus and the rear apparatus. Accordingly, it is possible to safely deal with a jam or the like of a recording medium that has occurred in the front vertical transport path of the front apparatus.

Also, in the above image recording system, it is preferable to adopt a configuration in which a cover that can be opened and closed is provided in a portion where the rear face of the space in which the rear apparatus is stored opposes at least the rear vertical transport path of the rear apparatus, and when the cover is opened, both the front apparatus and the rear apparatus stop operation. Also, it is preferable that when the cover is opened, the rear vertical transport path of the rear apparatus can be opened to the rear.

By adopting such a configuration, it is possible to easily deal with a jam or the like of a recording medium that has occurred in the rear vertical transport path of the rear apparatus.

Also, in the above image recording system, it is preferable to adopt a configuration in which a cover that can be opened and closed is provided in at least a portion of a side face of the bypass transport path of the bypass transport portion, and when the cover is opened, both the front apparatus and the rear apparatus stop operation. Also, it is preferable that a cover that can be opened and closed is provided in at least a portion of a top face of the bypass transport path of the bypass transport portion, and when the cover is opened, both the front apparatus and the rear apparatus stop operation. Also, it is preferable that when the cover, which can be opened and closed and is provided in the top face of the bypass transport path of the bypass transport means, is opened, at least a portion of the bypass transport path of the bypass transport portion can be opened upward.

By adopting such a configuration, it is possible to safely and easily deal with a jam or the like of a recording medium that has occurred in the bypass transport path of the bypass transport means.

The above image recording system is configured using a plurality of image recording apparatuses, but as described above, it may also be configured using two image recording apparatuses. In this case, a configuration may be adopted in which image recording apparatuses with different processing speeds are used, or alternatively, image recording apparatuses with different recording resolutions are used, or alternatively, image recording apparatuses in which the type of recording medium used is different are used. Also, a configuration may be adopted in which one of the two image recording apparatuses is a color image recording apparatus, and the other is a monochrome image recording apparatus. By adopting such a configuration, it is possible to respond to various requirements for processing using the image recording apparatuses, and an image recording system with high cost performance can be configured with low cost.

As described above, according to the image recording system of the present invention, this image recording system is configured with a plurality of image recording apparatuses. Accordingly, it is possible to use a plurality of image recording apparatuses at the same time, and by using this plurality of image recording apparatuses at the same time, it is possible to improve the overall processing speed in the image recording apparatuses. Further, in the image recording apparatuses that constitute the image recording system of the present invention, a plurality of recording medium storage portion can be provided, and so it is possible to achieve an increase in the amount of recording paper in this image recording system.

Also, as described above, the image recording system of the present invention is provided with a tail apparatus, a main apparatus, a bypass transport means, and a recording medium storage means, and is formed by providing the bypass transport means in the main apparatus, and disposing the main apparatus provided with the bypass transport means together in a line with the tail apparatus, for example. Thus, if production is finished for an image forming apparatus formed by the tail apparatus and the main apparatus, by simply preparing the bypass transport means, it is possible to form an image recording system provided with a plurality of image recording apparatuses and a recording medium storage means, with a brief method such as later installing the bypass transport means in an image recording apparatus and installing each apparatus. Accordingly, it is possible, with low cost, to form an image recording system in which processing speed can be improved, and an image recording system with high cost performance can be provided.

Also, as described above, the image recording apparatuses used to configure the image recording system of the present invention can be independently used as stand-alone devices due to providing the recording medium storage means, and the bypass transport means can be installed in the main apparatus later. Accordingly, it is possible to configure the image recording system by installing the bypass transport means in the main apparatus later, by using an image recording apparatus in which the recording medium storage means has been removed from a stand-alone device that is already operating as an image recording apparatus provided with the recording medium storage means, an image recording apparatus that is a new product, or the like as the main apparatus. Accordingly, a stand-alone device that is already operating can be systemized as an image recording system, and it is possible to achieve an improvement in the properties of such a stand-alone device that is already operating with low cost.

Also, as described above, the bypass transport means of the image recording system of the present invention can be provided such that it crosses over the top of an image recording apparatus, and in this case, it is possible to configure the bypass transport path such that at least a portion can be opened upward. Accordingly, it is possible to easily deal with a jam of a recording medium that has occurred in the bypass transport means, or to perform maintenance related to the bypass transport means.

Also, as described above, in the image recording system of the present invention, it is possible to provide a top storage means, which stores a recording medium being transported by the bypass transport path of the bypass transport means branched from the bypass transport path, above the bypass transport means. Accordingly, by using the top storage means, when processing a plurality of jobs in parallel, it is possible to store recording media distinguished by each job unit.

Also, as described above, the bypass transport means of the image recording system of the present invention can control the transport of a recording medium that is transported in the bypass transport path of the bypass transport means such that it can be temporarily held in the bypass transport path. Accordingly, when processing is performed by distributing a single job to a plurality of image recording apparatuses, it is possible to control transport such that recording media that have been discharged from a plurality of image recording apparatuses do not collide in the transport paths, and it is possible to smoothly perform storage of recorded storage media for processing performed by distributing a single job to a plurality of image recording apparatuses.

Also, as described above, in the image recording system of the present invention configured with a front apparatus and a rear apparatus, a first maintenance space that is faced by both the rear vertical transport path of the front apparatus and the front vertical transport path of the rear apparatus is formed, and so the first maintenance space can be used as a space for dealing with a jam of a recording medium that has occurred in the rear vertical transport path of the front apparatus and a jam of a recording medium that has occurred in the front vertical transport path of the rear apparatus. Accordingly, it is possible to easily deal with a jam of a recording medium that has occurred in the rear vertical transport path of the front apparatus or the front vertical transport path of the rear apparatus.

Also, as described above, likewise, in the image recording system of the present invention configured with a front apparatus and a rear apparatus, a second maintenance space that is faced by the front vertical transport path of the front apparatus is formed, and so the second maintenance space can be used as a space for dealing with a jam of a recording medium that has occurred in the front vertical transport path of the front apparatus. Accordingly, it is possible to easily deal with a jam of a recording medium that has occurred in the front vertical transport path of the front apparatus.

Also, as described above, the image recording system of the present invention can be configured using two image recording apparatuses, and in this case, a configuration may be adopted in which as the two image recording apparatuses, image recording apparatuses with different specifications such as processing speed are used, or alternatively, image recording apparatuses with different recording resolutions are used, or alternatively, image recording apparatuses in which the type of recording medium used is different are used. Also, a configuration may be adopted in which one of the two image recording apparatuses is a color image recording apparatus, and the other is a monochrome image recording apparatus. By adopting such a configuration, it is possible to respond to various requirements for processing using the image recording apparatuses, and an image recording system with high cost performance can be configured with low cost.

DESCRIPTION OF THE PREFERRED EMBODIMENTS

Hereinafter, an embodiment of the present invention will be described with reference to the accompanying drawings. The image recording system in the present embodiment is one type of compound system in which all functions provided by a copy machine and a print apparatus are provided, and is a system in which two image recording apparatuses, namely a color image recording apparatus and a monochrome image recording apparatus, are used as image forming apparatuses.

<Overall Configuration>

Figure 1:
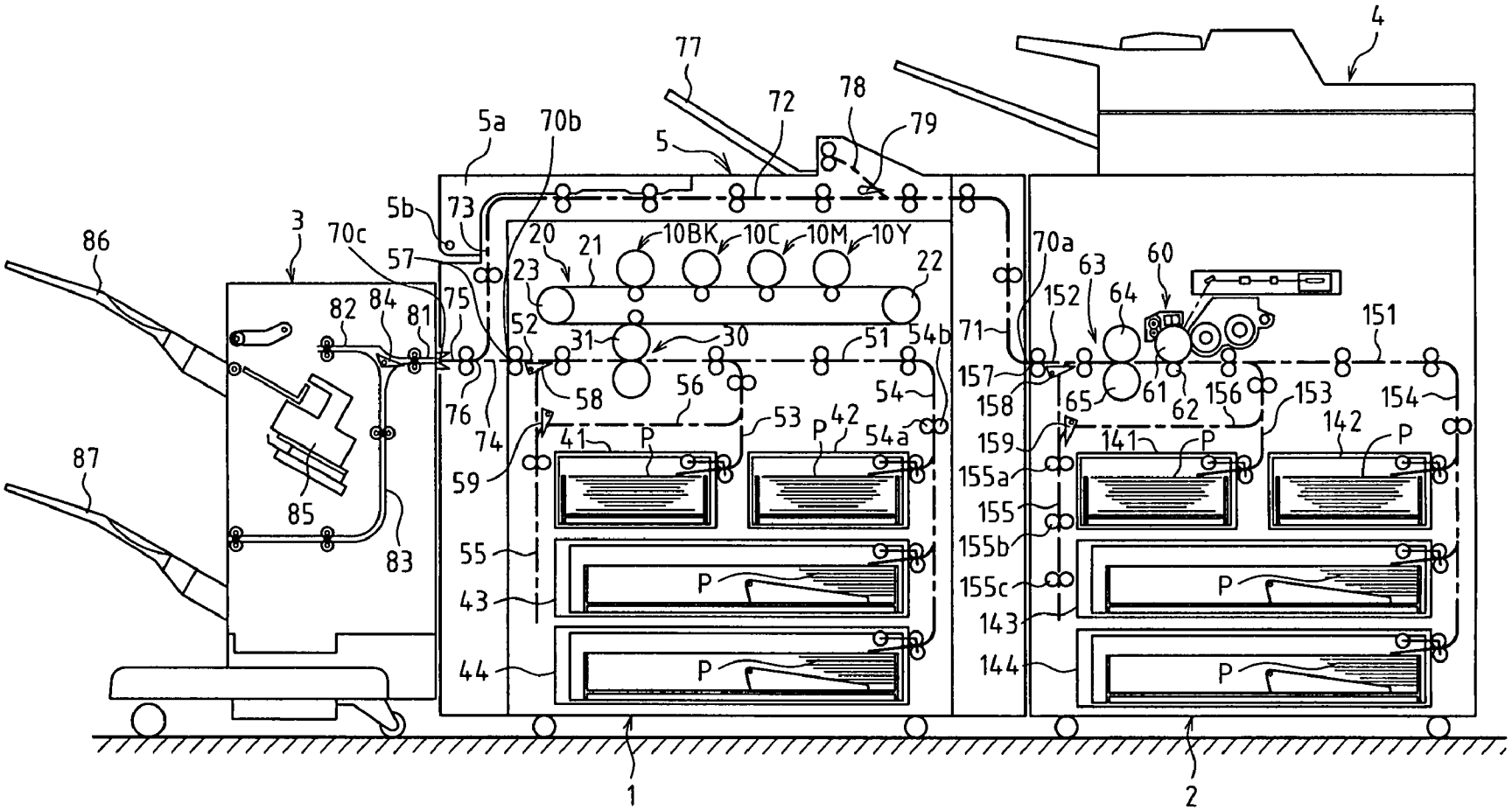
FIG. 1 is a configuration diagram of an image recording system in the present embodiment.

FIG. 1 is a configuration diagram of an image recording system in the present embodiment. In FIG. 1, the image recording system of the present embodiment is configured with a color image recording apparatus 1, a monochrome image recording apparatus 2, a final processing apparatus 3, a color image reading apparatus 4, and a bypass transport apparatus 5. Among these, the bypass transport apparatus 5 has a case in the shape of an upside-down U (or a concave-like shape) when viewed from the side, and is installed so as to cover the color image recording apparatus 1. Also, the color image reading apparatus 4 is installed on top of the monochrome image recording apparatus 2. In a line from front to rear, with the final processing apparatus 3 in the lead position, the color image recording apparatus 1 on which the bypass transport apparatus 5 is installed, and the monochrome recording apparatus 2 on which the color image reading apparatus 4 is installed, are joined (linked) in series.

Also, the processing speed of the color image recording apparatus 1 used in this image recording system is about 70 sheets/minute, while the processing speed of the monochrome image recording apparatus 2 is about 110 sheets/minute. Accordingly, in this image recording system, the color image recording apparatus 1 and the color image recording apparatus 2 are two image recording apparatuses disposed front to rear, and the color image recording apparatus 1, whose processing speed is slower, is disposed in front, and the monochrome image recording apparatus 2, whose processing speed is faster, is disposed in the rear.

Figure 2:
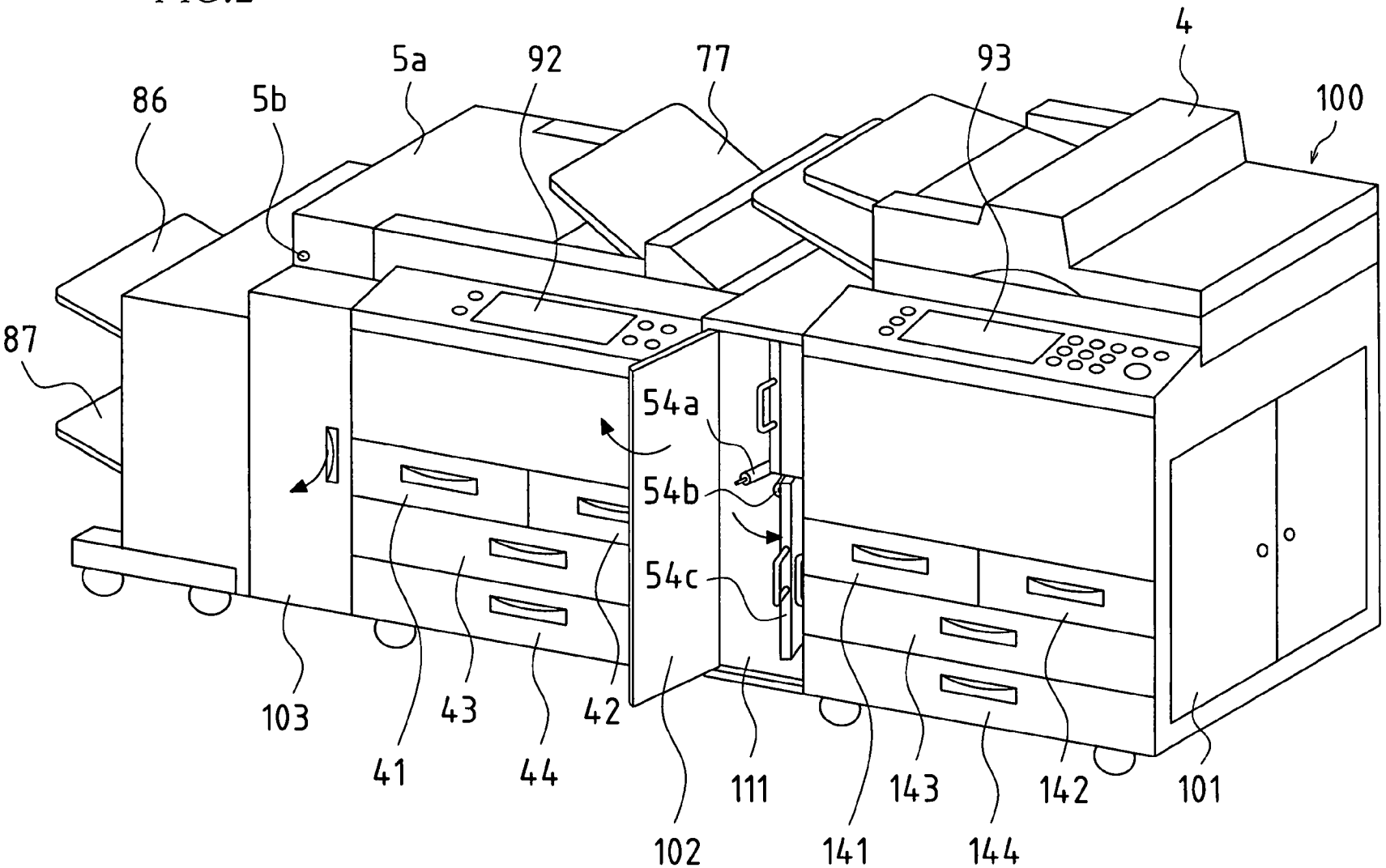
FIG. 2 is a perspective view (first) that shows the external appearance of an image recording system in the present embodiment.
Figure 3:
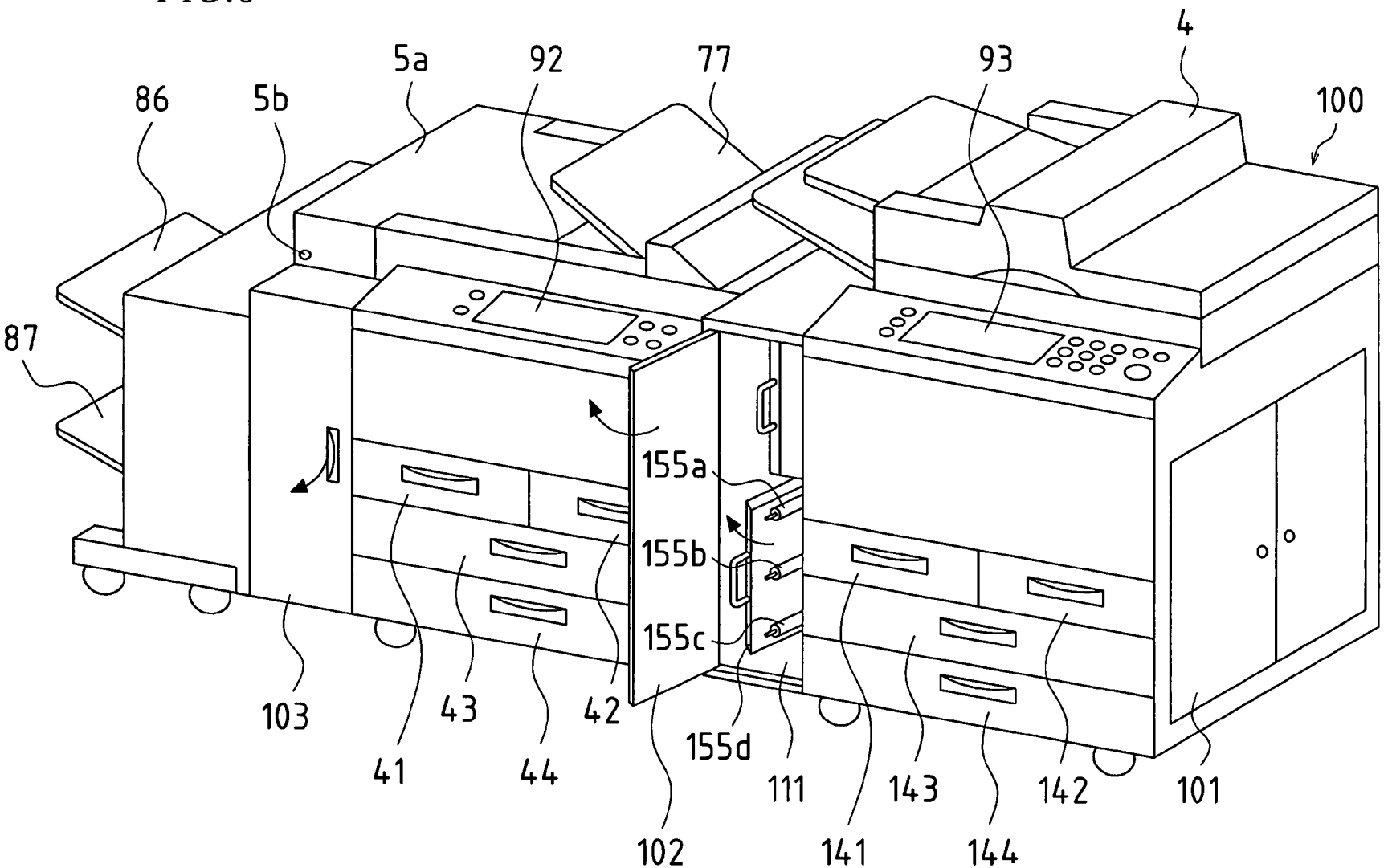
FIG. 3 is a perspective view (second) that shows the external appearance of an image recording system in the present embodiment.

Also, each of the above apparatuses used in this image recording system is housed in a cabinet 100, as shown in FIGS. 2 and 3. A double rear face door 101 is provided in the rear end face of the cabinet 100, a single side face rear door 102 is provided in both side faces of the rear end of the bypass transport path apparatus 5, and a single side face front door 103 is provided in both faces of the front end of the bypass transport path apparatus 5, and as described below, these are used when performing maintenance work or the like.

In this image recording system, the color image recording apparatus 1 corresponds to the aforementioned lead apparatus and main apparatus, and the monochrome image recording apparatus 2 corresponds to the aforementioned tail apparatus and a rear apparatus relative to the color image recording apparatus 1. Also, the bypass transport apparatus 5 corresponds to the aforementioned bypass transport means, and the final processing apparatus 3 corresponds to the aforementioned recording media storage means. Also, the color image reading apparatus 4 is an apparatus that captures color images, and is not directly involved in image recording, so stopping with stating that a color scanner is ordinarily used as the color image reading apparatus 4, a description of the configuration of the color image reading apparatus 4 is omitted. Below is a description of each of these apparatuses.

<Color Image Recording Apparatus>

Figure 4:
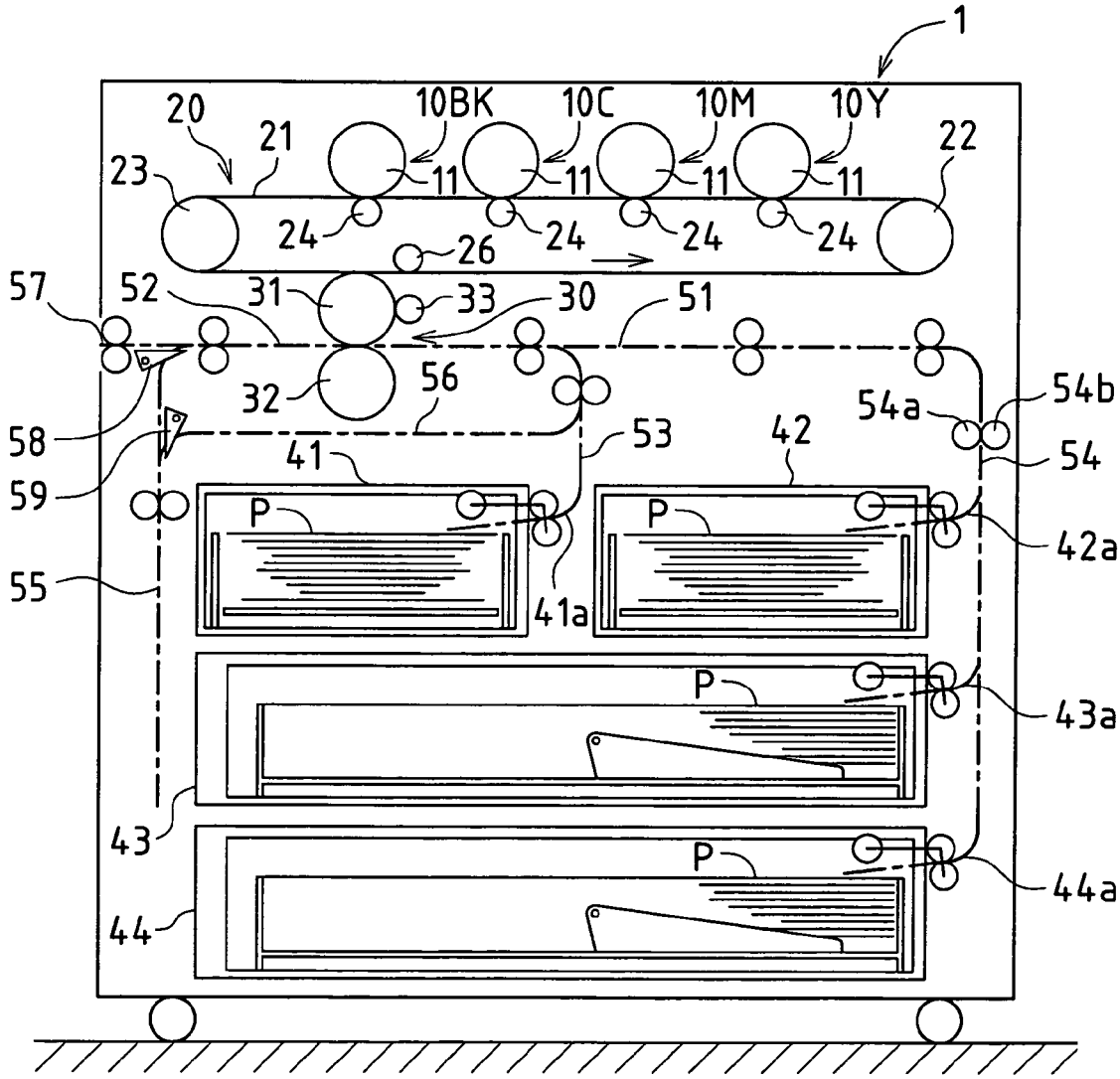
FIG. 4 is a configuration diagram of a color image recording apparatus used in an image recording system in the present embodiment.

First, the color image recording apparatus 1 will be described. FIG. 4 is a configuration diagram of the color image recording apparatus 1. In FIG. 4, the color image recording apparatus 1 is configured with four image forming units 10BK, 10C, 10M, and 10Y, an intermediate transfer unit 20, a transfer fixing unit 30, a first recording paper storage tray 41, a second recording paper storage tray 42, a third recording paper storage tray 43, a fourth recording paper storage tray 44, a horizontal supply transport path 51, a horizontal discharge transport path 52, a first vertical transport path 53, a second vertical transport path 54, a third vertical transport path 55, and a horizontal return transport path 56.

Incidentally, the color image recording apparatus 1 adopts a tandem system as a method of recording a color image on a recording paper P, which is a recording medium. In this tandem system, a semiconducting endless belt is rotatably provided, a plurality of image forming portions that individually form visible images with colors different from each other are disposed in a line in the movement direction of the outer circumferential face of the endless belt, and within at least one rotation of the endless belt a color image is formed.

In the above tandem system, conventionally, an intermediate transfer system exists in which after visible images of each color formed with each image forming portion are layered on the outer circumferential face of the endless belt, they are transferred onto the recording paper P, and a transfer-transport system exists in which the visible images of each color formed with each image forming portion are transferred in order to the surface of recording paper that is attracted to the outer circumferential face of the endless belt and transported.

Figure 5:
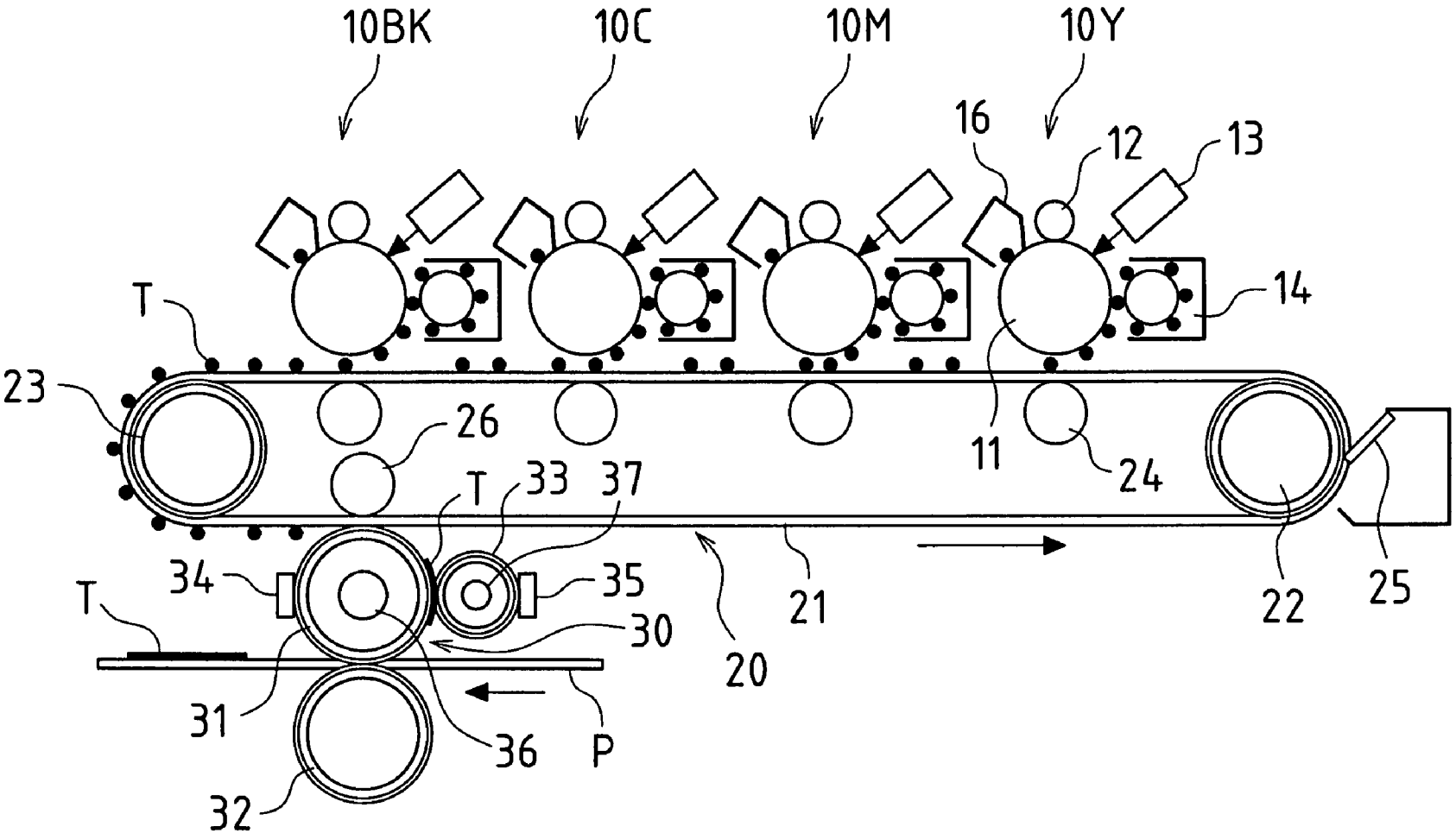
FIG. 5 is a configuration diagram of a new tandem-type system used in a color image recording apparatus of an image recording system in the present embodiment.

However, in the above tandem system, recently, a new system has been developed that differs from the above intermediate transfer system and transfer-transport system, and this new system is adopted also in the above color image recording apparatus 1. This new tandem system is configured from, among the constituent elements that constitute the above color image recording apparatus 1, the four image forming units 10BK, 10C, 10M, and 10Y, the intermediate transfer unit 20, and the transfer fixing unit 30. FIG. 5 is a configuration diagram that shows the configuration of this new tandem system.

In FIG. 5, in each of the image forming units 10Y, 10M, 10C, and 10BK, a charging roller 12, a laser illuminating means 13, a development unit 14, and a cleaner 16 are disposed around a photosensitive drum 11, and toners T of each color yellow (Y), magenta (M), cyan (C), and black (B) are stored in the development units of these image forming units.

The intermediate transfer unit 20 is configured from an intermediate transfer belt 21, an intermediate transfer belt drive roller 22, an intermediate transfer belt tension roller 23, a first transfer roller 24 for providing an electrical field between the photosensitive drum 11 and the intermediate transfer belt 21 and performing electrical field transfer of toner T onto the intermediate transfer belt 21 from the photosensitive drum 11, an intermediate transfer belt cleaning unit 25 for cleaning transfer remaining toner T on the intermediate transfer belt 21, and a second transfer backup roller 26 for transferring toner T from the intermediate transfer belt 21 to a transfer fixing roller 31. Among these, the intermediate transfer belt 21 is suspended by the intermediate transfer belt drive roller 22 and the intermediate transfer belt tension roller 23, and is rotationally driven in the direction of the arrow by an unshown driving means and the intermediate transfer belt drive roller 22.

The transfer fixing unit 30 is configured from the transfer fixing roller 31, a heat lamp 36 that is an internal heat source for heating the transfer fixing roller 31, a pressure roller 32, a temperature detection member 34, and the like. Further, in addition to these, a pressure heat roller 33 that, on the transfer fixing roller 31, applies pressure and heat to toner T that has been melted with heat on the transfer fixing roller 31, a heat lamp 37 that is a heat source for heating the pressure heat roller 33 from inside, a temperature detection member 35 for detecting the heat of the pressure heat roller 33, and the like are provided. Also, by an unshown paper transport member, the recording paper P is transported to a transfer fixing nip, which is a contact portion of the transfer fixing roller 31 and the pressure roller (pressure member) 32.

The transfer fixing roller 31 used in the above transfer fixing unit 30 has a heat lamp 36 inside that is a heat source for melting toner T on the transfer fixing roller 31 with heat, and the transfer fixing roller 31 controls heating such that its surface temperature is a constant temperature in a range of 120° C. to 180° C. This temperature is set to an optimum value for the toner material and process speed, the nip width and load conditions of the transfer fixing nip which is the contact portion of the transfer fixing roller 31 and the pressure roller 32, and the like.

In the above new tandem-type color image recording apparatus having this sort of configuration, first, using the first transfer roller 24, a visible image is transferred onto the intermediate transfer belt 21 from the photosensitive drum 11. Then, after this visible image transferred to the intermediate transfer belt 21 is again transferred to the transfer fixing roller 31, the visible image transferred to the transfer fixing roller 31 is transferred to the recording paper P and fixed. That is, with the above new tandem-type system color image recording apparatus, because the visible image is transferred to the recording paper P and fixed at the same time, the conventionally used fixing portion is not necessary. Thus, there is the advantage of being able to reduce the installation space of the fixing portion.

However, with the above new tandem-type system color image recording apparatus, the transfer fixing roller 31 of the transfer fixing unit 30, as stated above, controls heating such that its surface temperature is a constant temperature in a range of 20° C. to 180° C. in order to melt toner T on the transfer fixing roller 31 with heat. Accordingly, the heated intermediate transfer belt 21 moves to the position of the image forming unit 10Y, and there is a risk that the heat of the intermediate transfer belt 21 will exert an adverse effect such as melting the toner T that is affixed to the photosensitive drum 11 of the image forming unit 10Y.

Accordingly, in order to prevent the heat of the intermediate transfer belt 21 from exerting an adverse effect on the image forming unit 10Y, until the intermediate transfer belt 21 has passed the transfer fixing roller 31 and moves to the position of the image forming unit 10Y, it is necessary for the intermediate transfer belt 21 to radiate heat. Thus, in the above new tandem-type system, as shown in FIG. 5, in the intermediate transfer belt 21, the transfer fixing roller 31 of the transfer fixing unit 30 is disposed at a position such that the belt movement distance from the transfer roller 31 of the transfer fixing unit 30 to the frontmost image forming unit 10Y is as long as possible.

That is, on the top side of the intermediate transfer belt 21, which is stretched between the intermediate transfer belt tension roller 23 disposed in front and the intermediate transfer belt drive roller 22 disposed to the rear, the image forming unit 10Y, the image forming unit 10M, the image forming unit 10C, and the image forming unit 10B are disposed from front to rear, and with respect to the arrangement of these image forming units, by disposing the transfer fixing unit 30 near the front of the bottom side of the intermediate transfer belt 21, the movement distance of the intermediate transfer belt 21 from the transfer fixing roller 31 to the frontmost image forming unit 10Y is made the longest within the possible range in the mechanism.

In the above color image recording apparatus 1, the configuration and arrangement of the recording paper storage trays used to store the recording paper P are as follows. The intermediate transfer unit 20, as stated above, is disposed stretched between the intermediate transfer belt tension roller 23 disposed in front and the intermediate transfer belt drive roller 22 disposed to the rear, but the first recording paper storage tray 41 and the second recording paper storage tray 42 are disposed horizontal front to rear below the intermediate transfer unit 20.

Also, between the first recording paper storage tray 41 and the second recording paper storage tray 42, and the intermediate transfer unit 20, the transfer fixing unit 30 is disposed near the front, that is, above the first recording paper storage tray 41. The third recording paper storage tray 43 is disposed below the first recording paper storage tray 41 and the second recording paper storage tray 42, and the fourth recording paper storage tray 44 is disposed below the third recording paper storage tray 43.

Among these, the first recording paper storage tray 41 and the second recording paper storage tray 42 have the same structure and size, and the third recording paper storage tray 43 and the fourth recording paper storage tray 44 have the same structure and size. Also, the length of the third recording paper storage tray 43 and the fourth recording paper storage tray 44 in the front to rear direction is about the same as the length from the front edge of the first recording paper storage tray 41 to the rear edge of the second recording paper storage tray 42. Also, the widths of the above recording paper storage trays 41, 42, 43, and 44 are all the same. Also, the above recording paper storage trays 41, 42, 43, and 44 can be attached or removed from inside the color image recording apparatus 1 from the side face (in FIG. 1, the face on the front side) of the color image recording apparatus 1.

The above first recording paper storage tray 41 and second recording paper storage tray 42 are recording paper storage trays that store recording paper P that is A4 size or smaller, and the third recording paper storage tray 43 and fourth recording paper storage tray 44 are recording paper storage trays that store recording paper P that is a maximum of A3 size. Also, in each of the above recording paper storage trays 41, 42, 43, and 44, a recording paper detection sensor is provided that detects the presence or absence of the stored recording paper P.

Also, at the upper edge of the rear of the above first recording paper storage tray 41, the second recording paper storage tray 42, the third recording paper storage tray 43, and the fourth recording paper storage tray 44, as carry-out port paths for carrying out the recording paper P from inside the tray to outside, a first carry-out port path 41*a*, a second carry-out port path 42*a*, a third carry-out port path 43*a*, and a fourth carry-out port path 44*a* are respectively provided. In each of these carry-out port paths 41*a*, 42*a*, 43*a*, and 44*a*, a recording paper discharge roller is provided, and when carrying out the recording paper P from each paper storage tray, these recording paper discharge rollers are driven by an unshown driving means, carrying out the recording paper P.

In the above color image recording apparatus 1, the transport path that discharges the recording paper P is configured in the following manner. That is, because the recording of characters and figures on the recording paper P is performed at the transfer fixing nip formed by the transfer fixing roller 31 of the transfer fixing unit 30 and the pressure roller 32 making contact, it is necessary to transport the recording paper P to the transfer fixing nip. Thus, the horizontal supply transport path 51 that transports and supplies the recording paper P to the transfer fixing nip is formed such that it extends horizontally toward the rear from the transfer fixing nip of the transfer fixing unit 30. Also, the horizontal discharge transport path 52 that transports and discharges the recording paper P from the transfer fixing nip is formed such that it extends horizontally toward the front from the transfer fixing nip of the transfer fixing unit 30, and the front end of the horizontal discharge transport path 52 is a recording medium discharge port 57. This recording medium discharge port 57 corresponds to the aforementioned apparatus discharge port. Also, the horizontal discharge transport path 52 is connected to a front recording paper receiving port 70*b*, of the bypass transport apparatus 5, described below, with the recording medium discharge port 57, and via this portion, the horizontal discharge transport path 52 is connected to the final processing apparatus 3, likewise described below.

Also, the first vertical transport path 53 is formed facing upward from between the first recording paper storage tray 41 and the second recording paper storage tray 42, and the top end of the first vertical transport path 53 is connected to a midway portion of the horizontal supply transport path 51. Also, the second vertical transport path 54 is formed facing upward from the rear of the second recording paper storage tray 42, and the tope end of the second vertical transport path 54 is connected to the rear end of the horizontal supply transport path 51. These transport paths, as described below, are used to supply the recording paper P from each recording paper storage tray 41, 42, 43, and 44 to the transfer fixing unit 30, and discharge the supplied recording paper P.

Thus, the first carry-out port path 41*a* of the first recording paper storage tray 41 is connected to the above first vertical transport path 53, and the second carry-out port path 42*a* of the second recording paper storage tray 42, the third carry-out port path 43*a* of the third recording paper storage tray 43, and the fourth carry-out port path 44*a* of the fourth recording paper storage tray 44 are connected to the second vertical transport path 54.

Also, the third vertical transport path 55 is formed in front of the first recording paper storage tray 41 and the third recording paper storage tray 43, branched from the horizontal discharge transport path 52 and pointed downward. A transport path switching lever 58 is provided in the portion where the third vertical transport path 55 branches from the horizontal discharge transport path 52. Also, the horizontal return transport path 56 is formed horizontally between the first recording paper storage tray 41 and the transfer fixing unit 30, branched from the upper portion of the aforementioned third vertical transport path 55 and facing rearward, and the rear end of the horizontal return transport path 56 is connected to a midway portion of the first vertical transport path 53. A transport path switching lever 59 is provided in the portion where the horizontal return transport path 56 branches from the third vertical transport path 55. As described below, the third vertical transport path 55 and the horizontal return transport path 56 are provided in order to be able to record characters, figures, and the like on both sides of the recording paper P.

In the above horizontal supply transport path 51, the horizontal discharge transport path 52, the first vertical transport path 53, the second vertical transport path 54, the third vertical transport path 55, and the horizontal return transport path 56, a roller that is driven by an unshown driving means and a guide (not shown) are provided, and the recording paper P is transported by these rollers and guides.

Figure 6:
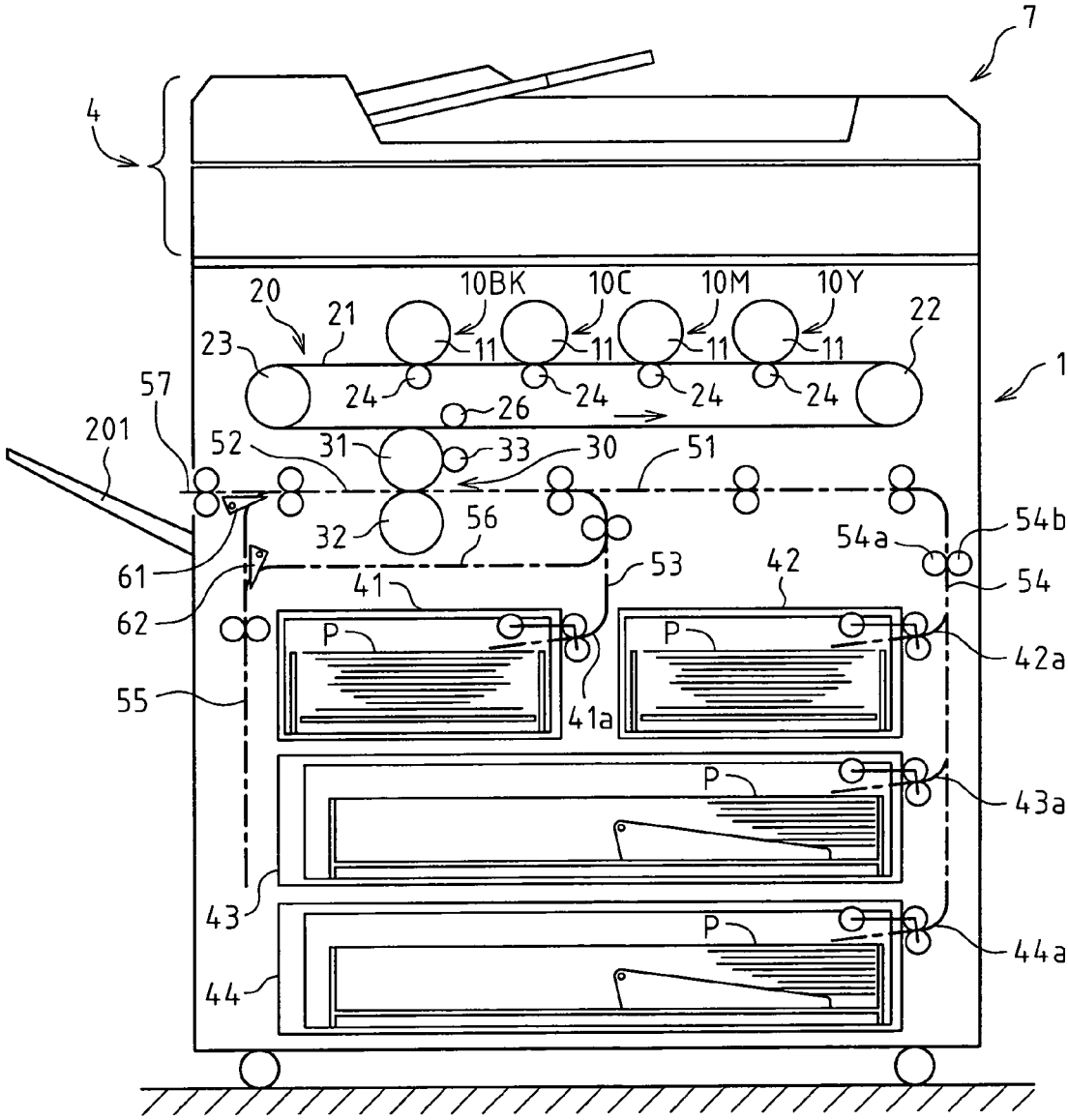
FIG. 6 is a configuration diagram of a color copy machine, configured by combining an independent color image recording apparatus used in an image recording system in the present embodiment and a color image reading apparatus.

In the above color image recording apparatus 1, by providing a discharge storage tray 201 in the recording medium discharge port 57, which is the front end of the horizontal discharge transport path 52, it is possible to independently use the color image recording apparatus 1 as an independent stand-alone device for color image recording. In this case, instead of the discharge storage tray 201, the final processing apparatus 3, described below, may be used. Also, by installing the color image reading apparatus 4 or the like on top of the color image recording apparatus 1, it can be used as a color copy machine. FIG. 6 is a configuration diagram of a color copy machine 7 that has been configured in this manner.

<Monochrome Image Forming Apparatus>

Figure 7:
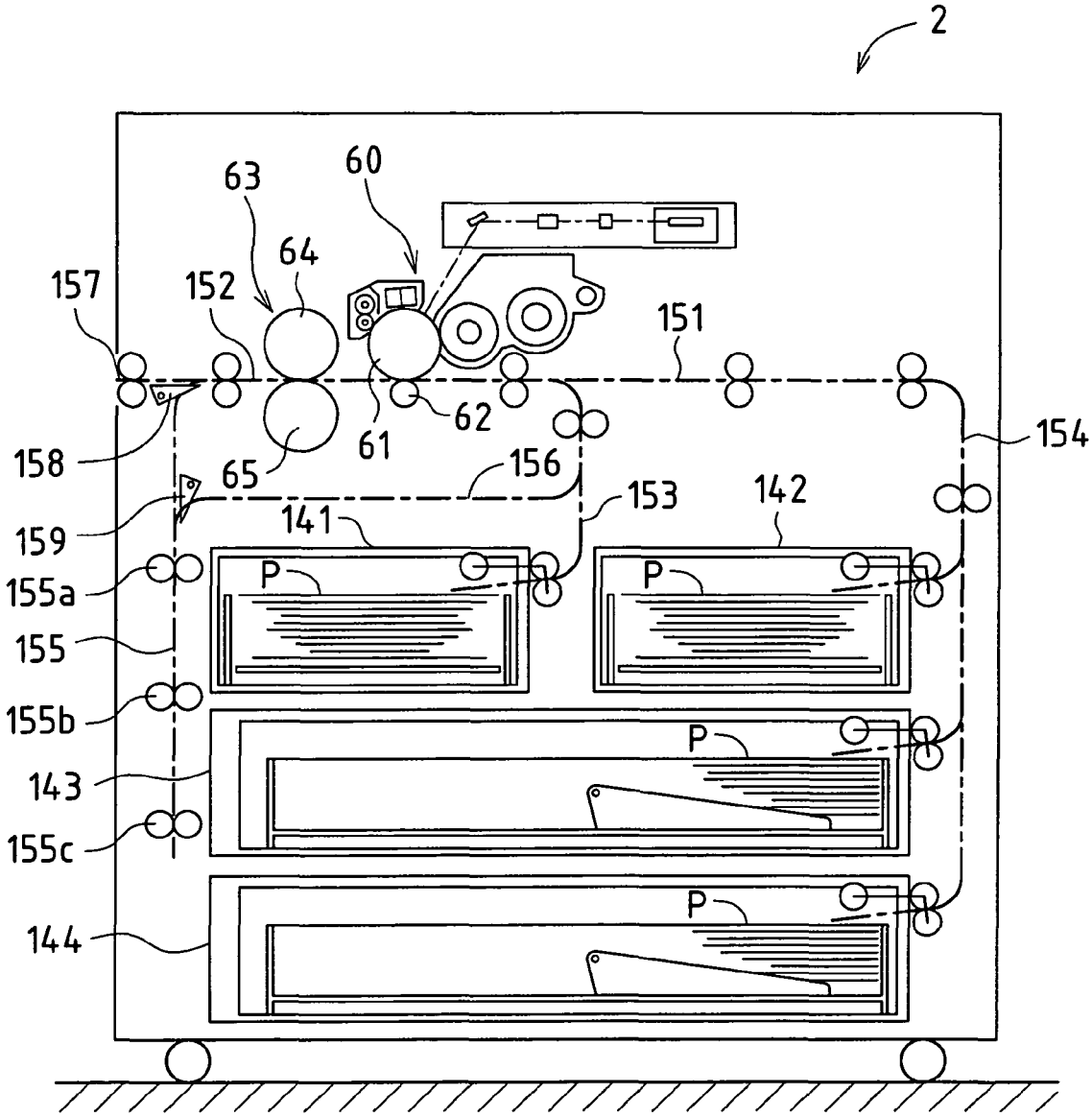
FIG. 7 is a configuration diagram of a monochrome image recording apparatus used in an image recording system in the present embodiment.

Next is a description of the monochrome image recording apparatus 2. The monochrome image recording apparatus 2 records characters, figures, or the like on the recording paper P. FIG. 7 shows the configuration of the monochrome image recording apparatus 2. In FIG. 7, the monochrome image recording apparatus 2 is configured with a monochrome image forming unit 60, a fixing unit 63, a first recording paper storage tray 141, a second recording paper storage tray 142, a third recording paper storage tray 143, a fourth recording paper storage tray 144, a horizontal supply transport path 151, a horizontal discharge transport path 152, a first vertical transport path 153, a second vertical transport path 154, a third vertical transport path 155, and a horizontal return transport path 156.

In the above monochrome image recording apparatus 2, different from the color image recording apparatus 1 described above, a fixing function is not included in the monochrome image forming unit 60, and separately, the fixing unit 63, configured with a fixing roller 64 and a pressure roller 65, is independently present. Also, in the above monochrome image forming unit 60, a portion configured with a photosensitive drum 61 and a pressure roller 62 is provided, and a monochrome image formed on the surface of the photosensitive drum 61 is transferred to the recording paper P.

Also, the recording paper storage trays for storing the recording paper P and the transport paths that transport the recording paper P in the above monochrome image recording apparatus 2 have exactly the same configuration and arrangement as the recording paper storage trays and transport paths in the color image recording apparatus 1 described above. Accordingly, their description is omitted here. However, the horizontal discharge transport path 152 of the monochrome image recording apparatus 2, different from the color image recording apparatus 1, at a recording medium discharge port 157 that is the front end of the horizontal discharge transport path 152, is connected to a rear recording paper receiving port 70*a* provided at the rear end of the bypass transport apparatus 5, described below, and is connected to the final processing apparatus 3, described below, via the bypass transport apparatus 5. In FIG. 7, portions related to the recording paper storage trays for storing the recording paper P and the transport paths that transport the recording paper P are indicated with numbers in the hundreds, and the last two digits of these numbers are the same as the numbers of the corresponding portions in the color image recording apparatus 1.

Also, as shown in FIGS. 2 and 3, the double rear face door 101 provided in the rear end face of the cabinet 100 faces the second vertical transport path 154 of the monochrome image recording apparatus 2. By opening the rear face door 101, a wide space that the second vertical transport path 154 faces is formed behind the second vertical transport path 154, and in this space it is possible to open the second vertical transport path 154. That is, in the second vertical transport path 154, which sandwiches the front and back of the recording paper P and transports the recording paper P, the side that makes contact with the front face of the recording paper P and the side that makes contact with the rear face are separated, the side facing the above space is moved into the above space, and it is possible to separate the side that makes contact with the front face of the recording paper P and the side that makes contact with the back face. Thus, when a jam of the recording paper P has occurred in the second vertical transport path 154, it is possible to easily remove the jammed recording paper P. In this manner, the rear face door 101 is used for maintenance work of the second vertical transport path 154.

Figure 8:
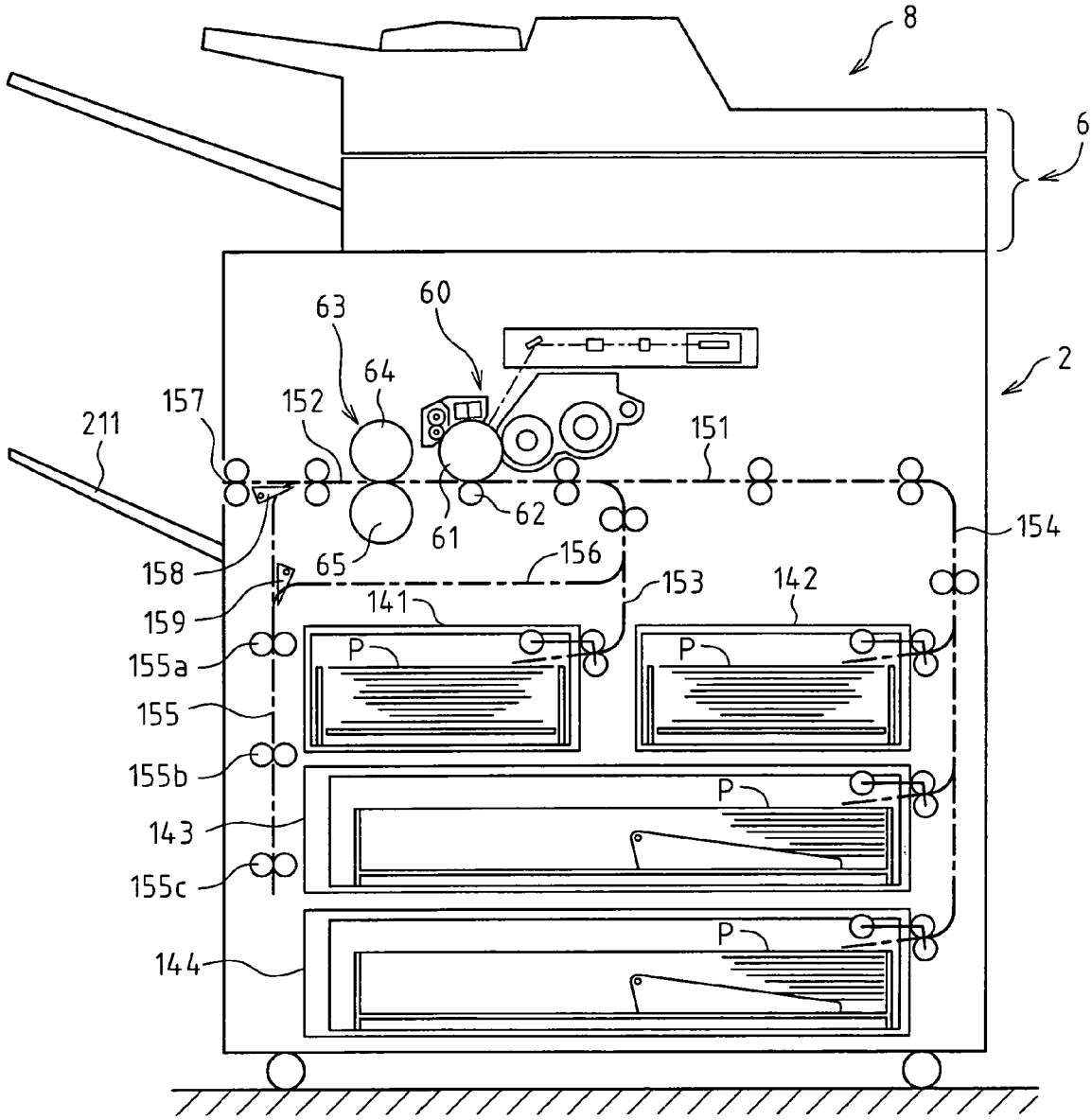
FIG. 8 is a configuration diagram of a monochrome copy machine, configured by combining an independent monochrome image recording apparatus used in an image recording system in the present embodiment and a monochrome image reading apparatus.

In the above monochrome image recording apparatus 2, by providing a discharge storage tray 211 in the recording medium discharge port 157 that is the front end of the horizontal discharge transport path 152, the monochrome image recording apparatus 2 can be independently used as a standalone device for monochrome image recording. In this case, instead of the discharge storage tray 211, the final processing apparatus 3 described below may also be used. Also, by installing a monochrome image reading apparatus 6 or the like on top of the monochrome image recording apparatus 2, it can be made a monochrome copy machine. FIG. 8 is a configuration diagram of a monochrome copy machine 8 configured in this manner.

<Bypass Transport Apparatus>

Figure 9:
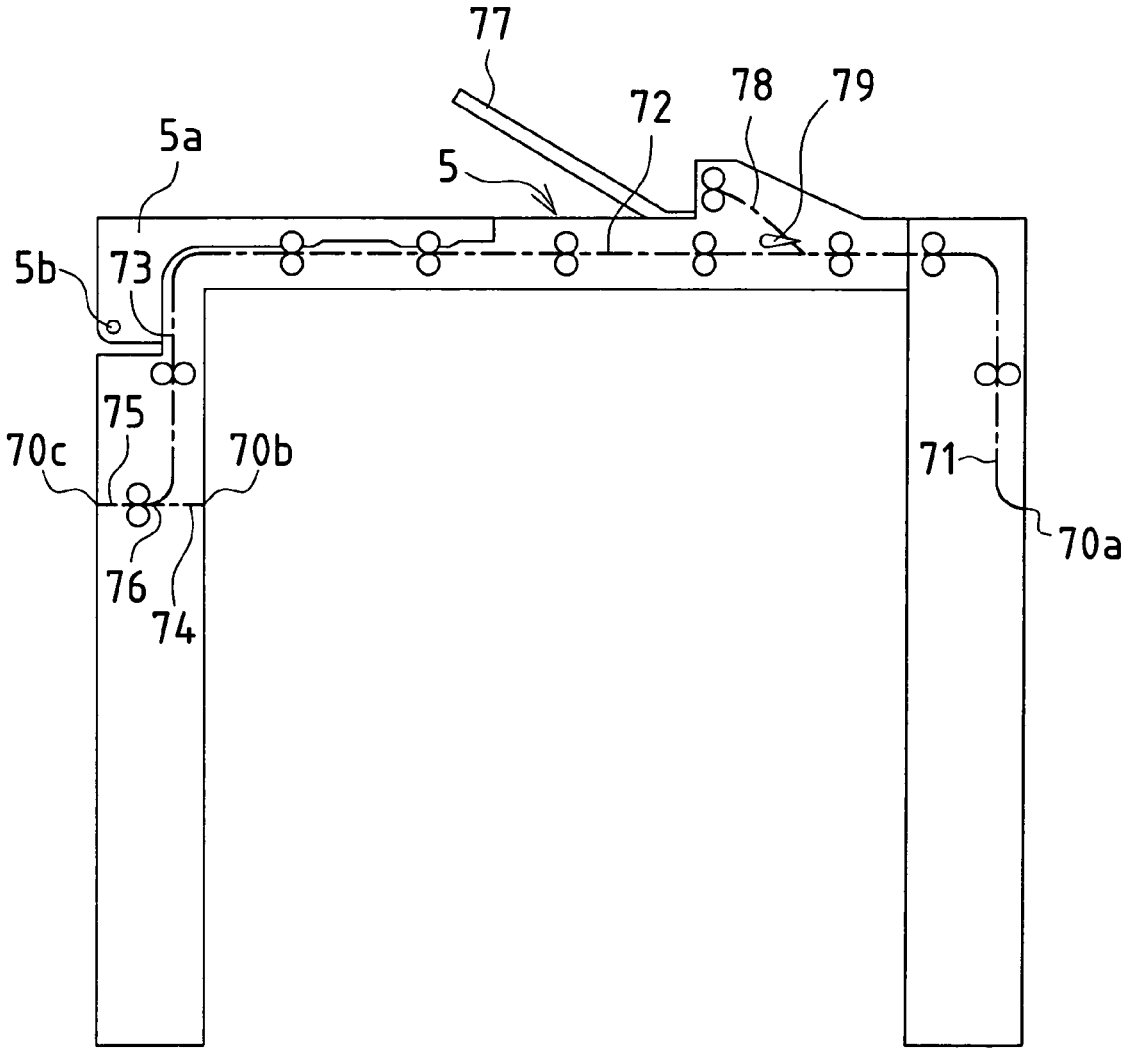
FIG. 9 is a configuration diagram of a bypass transport apparatus used in an image recording system in the present embodiment.

Next is a description of the bypass transport apparatus 5. FIG. 9 is a configuration diagram of the bypass transport apparatus 5. In FIG. 9, the bypass transport apparatus 5, as described above, the bypass transport apparatus 5 has a case in the shape of an upside-down U when viewed from the side, and is installed on top of the color image recording apparatus 1 so as to cover the color image recording apparatus 1. That is, the bypass transport apparatus 5 is installed such that it crosses the top of the color image recording apparatus 1.

As understood from FIG. 9, the bypass transport apparatus 5 is a separate apparatus independent from the color image recording apparatus 1 in which the bypass transport apparatus 5 is installed, and accordingly, it can be installed in the color image recording apparatus 1 later. Also, in this embodiment, the bypass transport apparatus 5 is used installed in the color image recording apparatus 1, but it may also be used installed in the monochrome image recording apparatus 2. The bypass transport apparatus 5 is configured with a bypass ascending transport path 71, a bypass horizontal transport path 72, a bypass descending transport path 73, a posterior transport path 74, and an anterior transport path 75.

Among these, the rear end portion of the bypass ascending transport path 71 forms a horizontal transport path, and the rear recording paper receiving port 70*a* is provided at the rear end of the rear end portion. The bypass ascending transport path 71 bends in a circular arc upward from the rear end portion to the midway portion, forms a vertical transport path in the midway portion, bends in a circular arc frontward from the midway portion to the front end portion, and forms a horizontal transport path in the front end portion.

Also, the bypass horizontal transport path 72 is a horizontal transport path, and its front end portion bends downward in a circular arc. Also, the bypass descending transport path 73 is a vertical transport path, and its bottom end portion bends frontward in a circular arc. Also, both the posterior transport path 74 and the anterior transport path 75 are horizontal transport paths, and a front recording paper receiving port 70*b* is provided at the rear end of the posterior transport path 74, and a transport apparatus recording paper discharge port 70*c* is provided in the front end portion of the anterior transport path 75.

In the above bypass transport apparatus 5, the rear end portion of the anterior transport path 75 is connected to the front end portion of the posterior transport path 74, and this connected portion is a main transport path merging midway portion 76. Also, the rear recording paper receiving port 70*a* that is provided in the rear end portion of the bypass ascending transport path 71 is connected to the recording medium discharge port 157 that is the front end portion of the horizontal discharge transport path 152 of the monochrome image recording apparatus 2. Also, the front end of the bypass ascending transport path 71 is connected to the rear end of the bypass horizontal transport path 72, and the bypass horizontal transport path 72 is connected to the tope end of the bypass descending transport path 73. The bottom end of the bypass descending transport path 73 merges with and is connected to the main transport path merging midway portion 76, which is the connecting portion of the posterior transport path 74 and the anterior transport path 75. Also, the rear end of the posterior transport path 74 is connected to the recording medium discharge port 57 that is the front end portion of the horizontal discharge transport path 52 of the color image recording apparatus 1, and the transport apparatus recording paper discharge port 70*c* that is provided in the front end portion of the anterior transport path 75 is connected to the rear end of a first storage horizontal transport path 81 of the final processing apparatus 3 described below.

In the above bypass transport apparatus 5, the bypass ascending transport path 71, the bypass horizontal transport path 72, and the bypass descending transport path 73 correspond to the aforementioned bypass transport path, and the posterior transport path 74 and the anterior transport path 75 correspond to the aforementioned main transport path. Also, the rear recording paper receiving port 70*a* corresponds to the aforementioned bypass rear receiving port, the front recording paper receiving port 70*b* corresponds to the aforementioned bypass front receiving port, and the transport apparatus recording paper discharge port 70*c* corresponds to the aforementioned bypass discharge port.

Also, in the bypass ascending transport path 71, the bypass horizontal transport path 72, the bypass descending transport path 73, the posterior transport path 74, and the anterior transport path 75 above, rollers driven by an unshown driving means and guides (not shown) are provided.

The above bypass transport apparatus 5 has a function to transport recording paper P that has been recorded in the color image recording apparatus 1 to the final processing apparatus 3, and to transport recording paper P that has been recorded in the monochrome image recording apparatus 1 to the final processing apparatus 3.

Also, on top of the bypass transport apparatus 5, a top storage transport path 78 and a top storage tray 77 are provided. The top storage transport path 78 is provided such that it branches from the bypass horizontal transport path 72, and receives and transports recording paper P transported by the bypass horizontal transport path 72 due to switching of a transport path switching lever 79, thus storing that recording paper P in the top storage tray 77. The top storage tray 77 is provided as a special recording paper storage tray for the monochrome image recording apparatus 2, in order to make it possible to store recording paper P that has been recorded with the monochrome image recording apparatus 2 in the midst of transport without transporting it to the final processing apparatus 3. The top storage tray 77 corresponds to the aforementioned top storage means.

Figure 10:
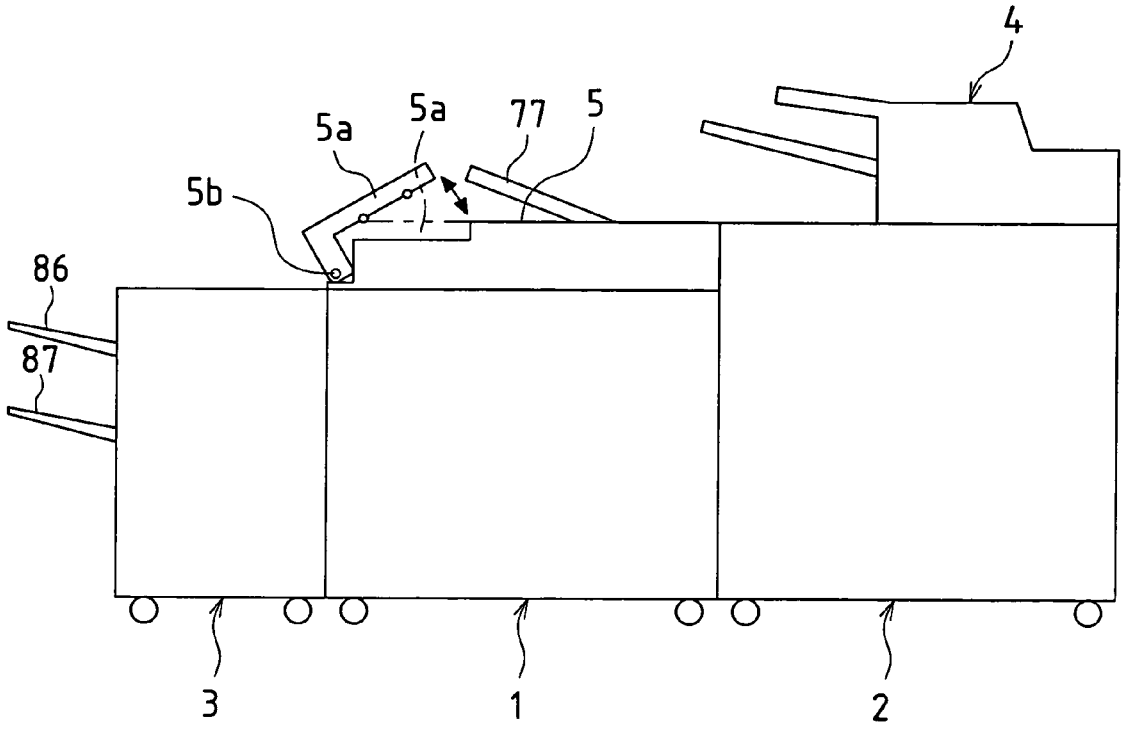
FIG. 10 is an explanatory diagram that shows an opening movement of the bypass transport path apparatus provided in the color image recording apparatus of an image recording system in the present embodiment.

Also, the top face portion of the case of the bypass transport apparatus 5, and a portion of the bypass horizontal transport path 72 of the bypass transport apparatus 5 and a portion of the bypass descending transport path 73, form a bypass transport path opening portion 5*a* configured in a single body. As shown in FIG. 10, the bypass transport path opening portion 5*a* can be opened upward, centering around a fulcrum 5*b* provided at the bottom end of the front end portion of the bypass transport path opening portion 5*a*. Thus, processing for jams of the recording paper P that have occurred in the bypass horizontal transport path 72 or the bypass descending transport path 73, maintenance, or the like can be easily performed.

Also, in the bottom portion of the rear end portion of the bypass transport apparatus 5, that is, in the bottom portion of the bypass ascending transport path 71, a first maintenance space 111 is formed that is faced by both the second vertical transport path 54 of the color image recording apparatus 1 and the third vertical transport path 155 of the monochrome image recording apparatus 2. In the second vertical transport path 54 of the color image recording apparatus 1 and the third vertical transport path 155 of the monochrome image recording apparatus 2 that face the first maintenance space 111, the transport paths that sandwich the front and back of the recording paper P and transport the recording paper P can separate the side that makes contact with the front face of the recording paper P and the side that makes contact with the back face, each side near the first maintenance space 111 is moved inside the first maintenance space 111, and the side that makes contact with the front face of the recording paper P and the side that makes contact with the back face can be separated. Thus, when a jam of the recording paper P has occurred in the second vertical transport path 54 of the color image recording apparatus 1 or the third vertical transport path 155 of the monochrome image recording apparatus 2, it is possible to easily remove the jammed recording paper P, and maintenance work or the like of these transport paths can easily be performed.

Also, as shown in FIGS. 2 and 3, a single side face rear door 102 is provided in both side faces of the rear end portion of the bypass transport apparatus 5 of the cabinet 100. The side face rear door 102 covers both side faces of the above first maintenance space 111 and both side faces of the space in which the bypass ascending transport path 71 of the bypass transport apparatus 5 is stored. Thus, by opening the side face rear door 102, maintenance work or the like of the second vertical transport path 54 of the color image recording apparatus 1 and the third vertical transport path 155 of the monochrome image recording apparatus 2, or alternatively, the bypass ascending transport path 71 of the bypass transport apparatus 5, can easily be performed. In this way, the side face rear door 102 is used for maintenance work of the second vertical transport path 54 of the color image recording apparatus 1 and the third vertical transport path 155 of the monochrome image recording apparatus 2, or alternatively, the bypass ascending transport path 71 of the bypass transport apparatus 5.

FIG. 2 shows a state in which the side face rear door 102 is opened, and a transport roller support plate 54*c* supporting a transport roller 54*b* on the side near to the first maintenance space 111 of the second vertical transport path 54 of the color image recording apparatus 1 is moved rearward, opening the second vertical transport path 54 of the color image recording apparatus 1 to the first maintenance space 111. Reference numeral 54*a* is a transport roller provided opposite to the transport roller 54*b*.

Also, FIG. 3 likewise shows a state in which the side face rear door 102 is opened, and a transport roller support plate 155*d* supporting transport rollers 155*a*, 155*b*, and 155*c* on the side near to the first maintenance space 111 of the third vertical transport path 155 of the monochrome image recording apparatus 2 is moved frontward, opening the third vertical transport path 155 of the monochrome image recording apparatus 2 to the first maintenance space 111.

Also, the lower portion of the front end portion of the bypass transport apparatus 5, that is, the posterior transport path 74, and below the anterior transport path 75, a second maintenance space 112 faced by the third vertical transport path 55 of the color image recording apparatus 1 is formed. With the third vertical transport path 55 of the color image recording apparatus 1, same as the second vertical transport path 54 of the color image recording apparatus 1 and the third vertical transport path 155 of the monochrome image recording apparatus 2, the transport paths that sandwich the front and back of the recording paper P and transport the recording paper P can separate the side that makes contact with the front face of the recording paper P and the side that makes contact with the back face, a side near the second maintenance space 112 is moved inside the second maintenance space 112, and it is possible to separate the side that makes contact with the front face of the recording paper P and the side that makes contact with the back face. Thus, when a jam of the recording paper P has occurred in the third vertical transport path 55 of the color image recording apparatus 1, it is possible to easily remove the jammed recording paper P, and maintenance work or the like of the third vertical transport path 55 of the color image recording apparatus 1 can easily be performed.

Also, a single side face front door 103 is provided in both side faces of the front end portion of the bypass transport apparatus 5 of the cabinet 100. The side face front door 102 covers both side faces of the above second maintenance space 112 and both side faces of the space in which the front end portion of the bypass transport path apparatus 5 are stored, that is, both side faces of the space in which the bypass descending transport path 73, the posterior transport path 74, and the anterior transport path 75 are stored. Thus, by opening the side face rear door 102, maintenance work or the like of the third vertical transport path 55 of the color image recording apparatus 1, or the front end portion of the bypass transport path apparatus 5, that is, the bypass descending transport path 73, the posterior transport path 74, and the anterior transport path 75, can easily be performed. In this way, the side face front door 102 is used for maintenance work of the third vertical transport path 55 of the color image recording apparatus 1 or the front end portion of the bypass transport path apparatus 5.

<Final Processing Apparatus>

Next is a description of the final processing apparatus 3. The final processing apparatus 3 stores recording paper P on which an image has been recorded by the color image recording apparatus 1 or the monochrome image recording apparatus 2. The final processing apparatus 3 is provided with a function to, when storing the recording paper P, store a plurality of sheets of the transported recording paper P in order, and to bind the plurality of stored sheets of recording paper P.

Thus, as shown in FIG. 1, a first storage horizontal transport path 81, a second storage horizontal transport path 82, a third storage transport path 83, a transport path switching lever 84, a finisher processing portion 85, a first storage tray 86, and a second storage tray 87 are provided in the final processing apparatus 3. Among these, the first storage horizontal transport path 81, the second storage horizontal transport path 82, and the third storage transport path 83 are used to transport the recording paper P that has been delivered from the anterior transport path 75 of the bypass transport apparatus 5 to the finisher processing portion 85 or the second storage tray 87.

The front end portion of the anterior transport path 75 of the bypass transport apparatus 5 is connected to the rear end portion of the first storage horizontal transport path 81, and the front end portion of the first storage horizontal transport path 81 is connected to the rear end portion of the second storage horizontal transport path 82 and the top end portion of the third storage transport path 83. The transport path switching lever 84 is provided in this connecting portion, and the transport path switching lever 84, switches whether the recording paper P that has been transported with the first storage horizontal transport path 81, which has a short transport distance, will be transported in the second storage horizontal transport path 82 or the third storage transport path 83. The third storage transport path 83 forms a vertical transport path pointing downward from the top edge portion, and forms a transport path that is horizontal after pointing approximately forward in the midway portion and bending in a circular arc. In the above first storage horizontal transport path 81, the second storage horizontal transport path 82, and the third storage transport path 83, rollers driven by a driving means that is not shown and guides (not shown) are provided.

The finisher processing portion 85 is disposed below the front end portion of the second storage horizontal transport path 82. The finisher processing portion 85 stocks recording paper P that has been transported by the second storage horizontal transport path 82, performs binding or the like, and feeds the recording paper P to the first storage tray 86. Also, recording paper P that has been transported by the third storage transport path 83 is stored in the second storage tray 87 in the order in which it was transported. As stated above, the final processing apparatus 3 corresponds to the aforementioned shared storage means, so as the aforementioned shared storage means, the first storage tray 86 where binding is possible, and the second storage tray 87 that simply stores the recording paper P in the order in which it was transported, are present, and it is possible to use the tray appropriate to the circumstances.

<Control of the Image Forming System>

Figure 11:
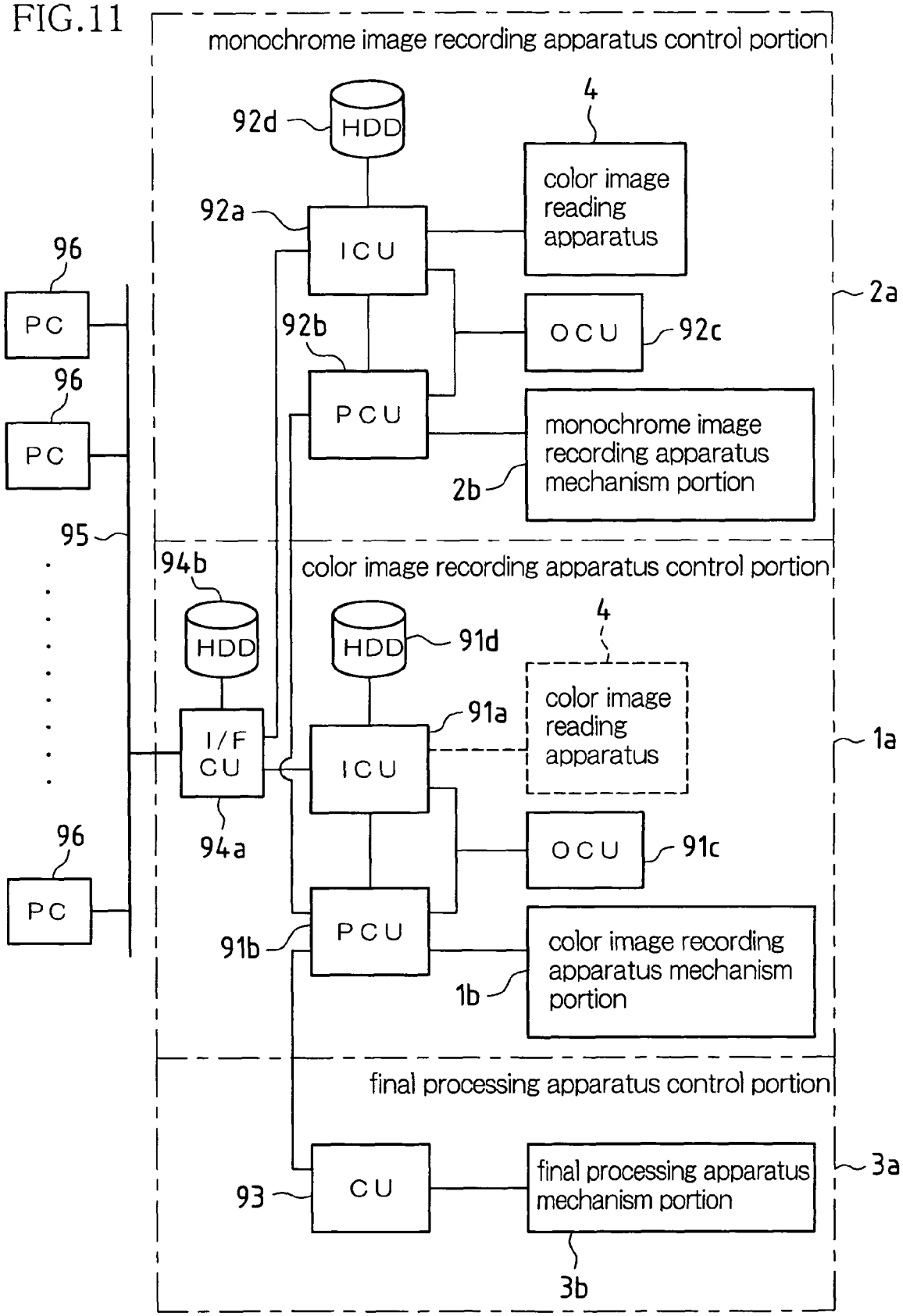
FIG. 11 is a block diagram that shows the configuration of a portion that performs control of an image recording system in this embodiment.

Next is a description of the control of the image forming system in the present embodiment. FIG. 11 is a block diagram that shows the configuration of a portion that performs control of the above image recording system. As stated above, the image recording system is configured with the color image recording apparatus 1 in which the bypass transport apparatus 5 is installed, the monochrome image recording apparatus 2 in which the color image reading apparatus 4 is installed, and the final processing apparatus 3, and basically, a control portion is provided in the color image recording apparatus 1, the monochrome image recording apparatus 2, and the final processing apparatus 3 such that each apparatus can be used independently.

That is, in the color image recording apparatus 1, the monochrome image recording apparatus 2, and the final processing apparatus 3, respectively, as shown in FIG. 11, a color image recording apparatus control portion 1*a*, a monochrome image recording apparatus control portion 2*a*, and a final processing apparatus control portion 3*a* are provided. Among these, in the color image recording apparatus control portion 1*a*, a function for control of the bypass transport apparatus 5 is included, and in the monochrome image recording apparatus control portion 2*a*, a function for control of the color image reading apparatus 4 is included. In addition, in the color image recording apparatus control portion 1*a*, a control function necessary for the image recording system in the present embodiment is also included. In FIG. 11, a color image recording apparatus mechanism portion 1*b*, a monochrome image recording apparatus mechanism portion 2*b*, and a final processing apparatus mechanism portion 3*b* are generic names for mechanism portions that include the transport paths in the color image recording apparatus 1 on which the bypass transport apparatus 5 is installed, the monochrome image recording apparatus 2, and the final processing apparatus 3, described above.

The color image recording apparatus control portion 1*a* is configured with a color image recording apparatus ICU 91*a*, a color image recording apparatus PCU 91*b*, a color image recording apparatus OCU 91*c*, and an HDD 91*d*. The color image recording apparatus ICU (image control unit) 91*a* performs processing related to color image information recorded with the color image recording apparatus 1. When the color image recording apparatus 1 is used as an independent stand-alone device, and when the color image reading apparatus 4 or the like, which is a color scanner, is installed on top of the color image recording apparatus 1 and used as a color copy machine 7, as shown by the dotted line in FIG. 11, the color image recording apparatus ICU 91*a* performs processing related to these color scanners. The HDD 91*d* temporarily stores the above color image information.

The color image recording apparatus PCU (print control unit) 91*b* performs control of the color image recording apparatus mechanism portion 1*b* that includes the bypass transport apparatus 5 installed in the color image recording apparatus 1 described above. However, when the color image recording apparatus 1 is used as an independent stand-alone device in the manner of the color copy machine 7, the function to control the bypass transport apparatus 5 is not necessary. Also, in each portion of the color image recording apparatus mechanism portion 1*b*, various driving means, various sensors, and the like not shown in FIGS. 1 and 4 are provided, and these various driving means, various sensors, and the like are connected to the color image recording apparatus PCU 91*b*.

The color image recording apparatus OCU (operator control unit) 91*c* is a portion operated by an operator who performs operation of the color image recording apparatus 1. In the color image recording apparatus OCU 91*c*, a liquid crystal display using a touch panel is used.

The monochrome image recording apparatus control portion 2*a* is configured with a monochrome image recording apparatus ICU 92*a*, a monochrome image recording apparatus PCU 92*b*, a monochrome image recording apparatus OCU 92*c*, and an HDD 92*d*. The monochrome image recording apparatus ICU (image control unit) 92*a*, basically, performs processing related to monochrome image information recorded with the monochrome image recording apparatus 2, but as in the present system, when the color image reading apparatus 4 is placed on the monochrome image recording apparatus 2, the monochrome image recording apparatus ICU 92*a* performs control related to the color image reading apparatus 4 also including processing of color image information captured in the color image reading apparatus 4. Also, when the monochrome image recording apparatus 2 is used as an independent stand-alone device, and when the monochrome image reading apparatus 6 or the like, which is a monochrome scanner, is installed on top of the monochrome image recording apparatus 2 and used as the monochrome copy machine 8, the monochrome image recording apparatus ICU 92*a* performs control related to these monochrome scanners. The HDD 92*d* temporarily stores the above image information.

The monochrome image recording apparatus PCU (print control unit) 92*b* performs control of the monochrome image recording apparatus mechanism portion 2*b* of the monochrome image recording apparatus 2 described above. In each portion of the monochrome image recording apparatus mechanism portion 2*b*, various driving means, various sensors, and the like not shown in FIG. 1 are provided, and these various driving means, various sensors, and the like are connected to the monochrome image recording apparatus PCU 92*b*. The monochrome image recording apparatus OCU (operator control unit) 92*c* is a portion operated by an operator who performs operation of the monochrome image recording apparatus 2. In the monochrome image recording apparatus OCU 92*c*, a liquid crystal display using a touch panel is used.

The final processing apparatus control portion 3*a* is configured with a final processing apparatus CU (control unit) 93. The final processing apparatus CU 93 performs control of the final processing apparatus mechanism portion 3*b*. In the final processing apparatus control portion 3*a*, an OCU (operator control unit) is not provided, and as information related to operating instructions to the final processing apparatus, information from the OCU of the color image recording apparatus control portion 1*a* or the monochrome image recording apparatus control portion 2*a* is used. In each portion of the final processing apparatus mechanism portion 3*b* of the final processing apparatus 3, various driving means, various sensors, and the like not shown in FIG. 1 are provided, and these various driving means, various sensors, and the like are connected to the final processing apparatus CU 93.

With respect to control of the image recording system in the present embodiment, other than the above, an I/FCU (interface control unit) 94*a* and an HDD 94*b* are provided in the color image recording apparatus control portion 1*a*. The I/FCU 94*a* is connected to a LAN 95 installed external to the above image recording system, and via the LAN 95, is connected to a personal computer (PC) 96 connected to the LAN 95. The I/FCU 94*a* receives image information transmitted to the above image recording system from the personal computer 96 via the LAN 95, and transmits that image information to the color image recording apparatus ICU 91*a* of the color image recording apparatus control portion 1*a* or the monochrome image recording apparatus ICU 92*a* of the monochrome image recording apparatus control portion 2*a*. The HDD 94*b* temporarily stores this image information.

Also, in the control of the above image recording system, the color image recording apparatus PCU 91*b* that performs control of the color image recording apparatus 1 and the monochrome image recording apparatus PCU 92*b* that performs control of the monochrome image recording apparatus 2 are connected to each other, and can exchange necessary information with each other. Also, in this system, the color image recording apparatus PCU 91*b* is provided with a function to manage the system as a whole. Thus, the color image recording apparatus PCU 91*b* gives instructions to the monochrome image recording apparatus PCU 92*b* and the final processing apparatus CU 93 such that the system can perform processing most efficiently.

The color image recording apparatus OCU 91*c* of the above color image recording apparatus control portion 1*a*, and the monochrome image recording apparatus OCU 92*c* of the above monochrome image recording apparatus control portion 2*a*, each exist independently, such that the color image recording apparatus OCU 91*c* of the above color image recording apparatus control portion 1*a*, essentially, only gives instructions to the color image recording apparatus 1, and likewise the monochrome image recording apparatus OCU 92*c* of the above monochrome image recording apparatus control portion 2*a*, essentially, only gives instructions to the monochrome image recording apparatus 2. For example, information such as the type of recording paper P stored in the color image recording apparatus 1 and the monochrome image recording apparatus 2, and the recording paper storage trays in which that recording paper P has been stored, is input separately from each of the color image recording apparatus OCU 91*c* and the monochrome image recording apparatus OCU 92*c*.

However, in the control of the above image recording system, in order to increase the efficiency of the system, the color image recording apparatus OCU 91*c* of the color image recording apparatus control portion 1*a*, and the monochrome image recording apparatus OCU 92*c* of the monochrome image recording apparatus control portion 2*a* have different roles from each other. That is, the monochrome image recording apparatus OCU 92*c* of the monochrome image recording apparatus 2 in which the color image reading apparatus 4 is installed performs input processing or the like of operation related to the color image reading apparatus 4, the monochrome image recording apparatus 2, the color image recording apparatus 1, and the final image processing apparatus 3. On the other hand, the operating state of the monochrome image recording apparatus 2 and the color image recording apparatus 1 is as indicated in the color image recording apparatus OCU 91*c*.

<Operation of Image Recording System>

Next is a description of a usage method of the image recording system in the present embodiment and operation of the above image recording system, based on FIGS. 1 to 11. First is a description of a case in which color image information that has been captured by the color image reading apparatus 4 is recorded using the color image recording apparatus 1. First, color image information desired to be copied is captured with the color image reading apparatus 4 by an operator operating the monochrome image recording apparatus OCU 92*c*, and the recording paper size and number of sheets on which to make copies are input from the monochrome image recording apparatus OCU 92*c*. Then, the image information that has been captured with the color image reading apparatus 4 is stored on the HDD 92*d* by the monochrome image recording apparatus ICU 92*a*. This image information is transmitted from the monochrome image recording apparatus ICU 92*a* to the color image recording apparatus PCU 91*b* via the monochrome image recording apparatus PCU 92*b*.

Accordingly, the color image recording apparatus PCU 91*b* transmits the above image information to the image forming units 10Y, 10M, 10C, and 10BK. Then, an image based on the above image information is transferred from the image forming units 10Y, 10M, 10C, and 10BK to the transfer fixing unit 30 via the intermediate transfer unit 20. Also, due to an instruction from the monochrome image recording apparatus OCU 92*c*, the instructed size of recording paper P is carried out from the recording paper storage tray in which it is stored, and supplied to the transfer fixing nip of the transfer fixing unit 30.

At this time, if the recording paper P is that stored in the first recording paper storage tray 41, the recording paper P that has been carried out from the first carry-out port path 41*a* is transported upward from the first vertical transport path 53, and from the midway portion of the horizontal supply transport path 51, is further transported frontward from the horizontal supply transport path 51 and supplied to the transfer fixing unit 30. Also, if the recording paper P is recording paper P that is stored in the second recording paper storage tray 42, the third recording paper storage tray 43, or the fourth recording paper storage tray 44, it is carried out from the second carry-out port path 42*a*, the third carry-out port path 43*a*, or the fourth carry-out port path 44*a*, transported upward by the second vertical transport path 54, and further transported frontward from the rear end portion of the horizontal supply transport path 51 by the horizontal supply transport path 51 and supplied to the transfer fixing unit 30.

The recording paper P that has been supplied to the transfer fixing unit 30, after being transferred with the transfer fixing unit 30, is further transported frontward from the transfer fixing unit 30 by the horizontal discharge transport path 52, and is delivered to the posterior transport path 74 of the bypass transport apparatus 5 via the recording medium discharge port 57 and the front recording paper receiving port 70*b* of the bypass transport apparatus 5. The paper that has been delivered to the posterior transport path 74 passes through the main transport path merging midway portion 76 and the anterior transport path 75, and is delivered to the final processing apparatus 3 via the transport apparatus recording paper discharge port 70*c*.

The recording paper P that has been delivered to the final processing apparatus 3 is stored in the first storage tray 86 or the second storage tray 87 by processing instructed from the monochrome image recording apparatus OCU 92*c* being performed by the final processing apparatus 3. For example, when the recording paper P is gathered together in the order in which it was recorded and then bound, the recording paper P, which has been delivered from the anterior transport path 75 of the bypass transport apparatus 5, is transported frontward by the first storage horizontal transport path 81, whose transport distance is short. At this time, the end of the transport path switching lever 84 is lowered downward, the recording paper P is transported by the second storage horizontal transport path 82 and pops out from the front end of the second storage horizontal transport path 82, and is stocked in the finisher processing portion 85. After a plurality of a predetermined number of pages of the recording paper P have been stocked in order in this way, they are bound, and then fed to the first storage tray 86 and stored in the first storage tray 86.

In the color image recording apparatus 1, when also recording on the other side of recording paper that has been recorded on one side with the transfer fixing unit 30, the transport path switching lever 58, provided in the portion where the third vertical transport path 55 branches from the horizontal supply transport path 51, is switched such that the end of the transport path switching lever 58 is raised upward. When doing so, when the recording paper P onto which an image has been transferred with the transfer fixing unit 30 has been transported frontward from the transfer fixing unit 30 by the horizontal discharge transport path 52, that recording paper P is introduced to the third vertical transport path 55 by the transport path switching lever 58. The recording paper P that has been introduced to the third vertical transport path 55 is transported downward by the third vertical transport path 55 and temporarily stopped.

At the same time as this stoppage, the transport path switching lever 59 that is provided in the portion where the horizontal return transport path 56 branches from the third vertical transport path 55 is switched such that the end of the transport path switching lever 59 moves frontward. In addition, when the recording paper P is transported upward, opposite to transport up to then, it is introduced to the horizontal return transport path 56 by the transport path switching lever 59, and transported to the rear by the horizontal return transport path 56, and further, by being transported by the first vertical transport path 53 and the horizontal supply transport path 51, the recording paper P is supplied to the transfer fixing unit 30 in a state with its front and back reversed. As a result, an image is recorded on both faces of the recording paper P.

Next is a description of a case in which monochrome image information that has been transmitted from the personal computer 96 via the LAN 95 is recorded using the monochrome image recording apparatus 2. First, the monochrome image information that has been transmitted from the personal computer 96 via the LAN 95 is received with the I/FCU 94*a*, and transmitted to the monochrome image recording apparatus ICU 92*a*. Then, the monochrome image information is transmitted to the monochrome image forming unit 60 by the monochrome image recording apparatus PCU 92*b*. Then, the monochrome image that has been formed on the surface of the photosensitive drum 61 is transferred to the recording paper P, and fixed by the fixing unit 63. Also, due to an instruction from the monochrome image recording apparatus PCU 92*b*, image recording paper P of the instructed size is carried out from the recording paper storage tray in which it is stored, and supplied to the transfer fixing nip of the transfer fixing unit 30.

In the monochrome image recording apparatus 2, the recording paper storage trays used to store the recording paper P and the transport paths that transport the recording paper P have exactly the same configuration and arrangement as the recording paper storage trays and transport paths in the color image recording apparatus 1 described above. Accordingly, the movement of the recording paper P carried out from the recording paper storage trays in which it is stored, supplied to the transfer fixing nip of the transfer fixing unit 30, and until being discharged by the horizontal discharge transport path 152, is exactly the same as the color image recording apparatus 1. Accordingly, the above recording paper P that has been transported by the horizontal discharge transport path 152 is ultimately delivered from the horizontal discharge transport path 152 to the bypass ascending transport path 71 of the bypass transport apparatus 5 via the recording medium discharge port 157 and the rear recording paper receiving port 70*a*. Then, the recording paper P that has been transported to the bypass ascending transport path 71 is transported through the bypass horizontal transport path 72 and the bypass descending transport path 73 in order, and passes through the main transport path merging midway portion 76 and the anterior transport path 75, and is delivered to the final processing apparatus 3 via the transport apparatus recording paper discharge port 70*c*.

The recording paper P that has been delivered to the final processing apparatus 3 is stored in the first storage tray 86 or the second storage tray 87 by processing instructed from the monochrome image recording apparatus OCU 92*c* being performed by the final processing apparatus 3. For example, when the recording paper P is simply stored in the order in which it was recorded, the recording paper P, which has been delivered from the anterior transport path 75 of the bypass transport apparatus 5, is transported frontward by the first storage horizontal transport path 81. In this case, the end of the transport path switching lever 84 is raised upward, and the recording paper P is transported by the third storage transport path 83 and is stored in the second storage tray 87.

The recording paper P that has been recorded with the monochrome image recording apparatus 2, when binding is not necessary, without storing the recording paper P in the final processing apparatus 3, can be stored in the top storage tray 77 provided on top of the bypass transport apparatus 5. In this case, the recording paper P that is transported by the bypass horizontal transport path 72 is received by switching of the transport path switching lever 79, transported, and stored in the top storage tray 77.

The mechanism that that records an image on both faces of the recording paper P is the same in the monochrome image recording apparatus 2 as in the color image recording apparatus 1.

Next is a description of a case in which both of the above are simultaneously performed, that is, a case in which color image information that has been captured by the color image reading apparatus 4 is recorded using the color image recording apparatus 1, and at the same time, monochrome image information that has been received from the personal computer 96 via the LAN 95 is recorded using the monochrome image recording apparatus 2.

In this case, the recording paper P that has been recorded by the color image recording apparatus 1 is transported frontward by the horizontal discharge transport path 52 of the color image recording apparatus 1 and discharged, delivered to the posterior transport path 74 of the bypass transport apparatus 5 via the recording medium discharge port 57 and the front recording paper receiving port 70*b* of the bypass transport apparatus 5, and arrives at the main transport path merging midway portion 76. On the other hand, the recording paper P that has been recorded by the monochrome image recording apparatus 2 is delivered from the horizontal discharge transport path 152 of the monochrome image recording apparatus 2 to the bypass ascending transport path 71 of the bypass transport apparatus 5 via the recording medium discharge port 157 and the rear recording paper receiving port 70*a* of the bypass transport apparatus 5, transported by the bypass ascending transport path 71, and arrives at the main transport path merging midway portion 76 via the bypass horizontal transport path 72 and the bypass descending transport path 73. That is, in the main transport path merging midway portion 76 of the bypass transport apparatus 5, the recording paper P that has been recorded by the color image recording apparatus 1 and the recording paper P that has been recorded by the monochrome image recording apparatus 2 are in conflict.

Accordingly, in order to avoid the above conflict, the color image recording apparatus PCU 91*b*, with respect to transport in the anterior transport path 75 of the bypass transport apparatus 5, gives priority to transport of the recording paper P that has been recorded by the color image recording apparatus 1. When it appears that a conflict is about to occur, the recording paper P that has been recorded by the monochrome image recording apparatus 2 is kept temporarily stopped midway in the bypass horizontal transport path 72 of the bypass transport apparatus 5, and after the recording paper P that has been recorded by the color image recording apparatus 1 has been transported to the anterior transport path 75, the recording paper P that has been recorded by the monochrome image recording apparatus 2 is transported to the anterior transport path 75.

Also, when the recording paper P that has been transported from the horizontal discharge transport path 52 of the color image recording apparatus 1 by the posterior transport path 74 and the anterior transport path 75 of the bypass transport apparatus 5 is transported through the first storage horizontal transport path 81 of the final processing apparatus 3, the color image recording apparatus PCU 91*b* lowers the end of the transport switching lever 84 downward, and the recording paper P is transported to the second storage horizontal transport path 82. Then, when the recording paper P that has been transported from the horizontal discharge transport path 152 of the monochrome image recording apparatus 2 by the bypass ascending transport path 71, the bypass horizontal transport path 72, the bypass descending transport path 73, and the anterior transport path 75 of the bypass transport apparatus 5 is transported through the first storage horizontal transport path 81 of the final processing apparatus 3, the end of the transport path switching lever 84 is lowered downward, and the recording paper P is transported to the third storage transport path 83.

By adopting a configuration as described above, while simultaneously performing the recording by the color image recording apparatus 1 and the recording by the monochrome image recording apparatus 2, the recording paper P that has been recorded by the color image recording apparatus 1 is ultimately stored in the first storage tray 86 of the final processing apparatus 3, and the recording paper P that has been recorded by the monochrome image recording apparatus 2 is stored in the second storage tray 87 of the final processing apparatus 3. That is, simultaneous processing is performed by the color image recording apparatus 1 and the monochrome image recording apparatus 2.

In the above case, that is, a case in which color image information that has been captured by the color image reading apparatus 4 is recorded using the color image recording apparatus 1, and at the same time, monochrome image information that has been received from the personal computer 96 via the LAN 95 is recorded using the monochrome image recording apparatus 2, a configuration may also be adopted in which the recording paper P that has been recorded with the color image recording apparatus 1, same as above, is stored in the first storage tray 87 of the final processing apparatus 3, but the recording paper P that has been recorded with the monochrome image recording apparatus 2 is stored in the top storage tray 77 provided on top of the bypass transport apparatus 5. In this case, the recording paper P that has been recorded by the monochrome image recording apparatus 2 and is being transported by the bypass horizontal transport path 72 is received by switching of the transport path switching lever 79, transported, and stored in the top storage tray 77.

In the above case, in the main transport path merging midway portion 76 of the bypass transport apparatus 5 described above, there is no risk of a conflict between the recording paper P that has been recorded by the color image recording apparatus 1 and the recording paper P that has been recorded by the monochrome image recording apparatus 2. Accordingly, it is possible to make complicated control unnecessary for the bypass transport apparatus 5.

In the above description related to the usage method of the above image recording system, a case was described by way of example in which when color image information that has been captured by the color image reading apparatus 4 is recorded using the color image recording apparatus 1, and monochrome image information that has been received from the personal computer 96 via the LAN 95 is recorded using the monochrome image recording apparatus 2, and furthermore, both of the above are performed at the same time. However, other than the above, a case in which monochrome image information that has been captured by the color image reading apparatus 4 is recorded using the monochrome image recording apparatus 2, or alternatively, a case in which color image information that has been received from the personal computer 96 via the LAN 95 is recorded using the color image recording apparatus 2, can be described by partially combining the description above.

Also, in the above image recording system, ordinarily, the above monochrome image recording apparatus 2 has a faster processing speed and a lower cost than the color image recording apparatus 1, but cannot record a color image. On the other hand, the color image recording apparatus 1 can record a color image, but has a slower processing speed and a higher cost than the monochrome image recording apparatus 2. Accordingly, by combining these properties, in the above image recording system, other than the above sort of usage, a usage also exists with which it is possible to increase cost performance.

For example, when recording images of a plurality of pages on the recording paper P, when pages including a color image and pages including a monochrome image are mixed, the pages including a color image are processed with the color image recording apparatus 1, and the pages including a monochrome image are processed with the monochrome image recording apparatus 2, and thus it is possible to improve the overall processing speed.

Also, for example, when it is necessary to urgently perform image recording of other item during image processing of a large amount of pages with only monochrome images by the monochrome image recording apparatus 2, by using the color image recording apparatus 1 it is possible to perform processing without stopping the monochrome image recording apparatus 2 presently being used for processing.

In the image recording system in the above embodiment, as image recording apparatuses, two image processing apparatuses with different specifications and processing speeds, namely the color image recording apparatus 1 and the monochrome image recording apparatus 2, are used, and the monochrome image recording apparatus 2 is disposed after the color image recording apparatus 1, but a configuration may also be adopted in which the order of disposal is reversed, with the monochrome image recording apparatus 2 disposed in front and the color image recording apparatus 1 disposed after the monochrome image recording apparatus 2. Alternatively, two of the same type of image recording apparatus can be used, such as two of the color image recording apparatus 1 or two of the monochrome image recording apparatus 2. Also, in the above combinations, two image recording apparatuses with different recording resolutions may be used. By adopting such a configuration, it is possible to form an image recording system with the highest cost performance, depending on the purpose of the image recording system.

<Effects Yielded by the Image Recording System>

Following is a description of effects yielded by the image recording system in the above embodiment. According to the above image recording system, the bypass transport apparatus 5 is installed in the color image recording apparatus 1, which is provided with the discharge storage tray 201 and can be used as a stand-alone device, and the image recording system is formed by installing, in a line, the color image recording apparatus 1 in which the bypass transport apparatus 5 is installed, the monochrome image recording apparatus 2 which, similar to the color image recording apparatus 1, is provided with the discharge tray 211 and can be used as a stand-alone device, and the final processing apparatus 3 that is shared by the color image recording apparatus 1 and the monochrome image recording apparatus 2.

Accordingly, by combining the color image recording apparatus 1 and the monochrome image recording apparatus 2, which can be used as stand-alone devices, it is possible to operate two image recording apparatuses at the same time, so the overall processing speed can be improved, and it is possible to configure the image recording system with low cost. Accordingly, it is possible to construct an image recording system with high cost performance. Also, by combining two stand-alone devices with different specifications, namely the color image recording apparatus 1 and the monochrome image recording apparatus 2, here as well, it is possible to configure an image recording system with high cost performance.

Also, the image recording apparatuses used in the configuration of the above image recording system, the color image recording apparatus 1 and the monochrome image recording apparatus 2, can be used independently as stand-alone devices by providing discharge storage trays, and the bypass transport apparatus 5 can be installed in the above image recording apparatuses later. Accordingly, the image recording system can be configured by later installing the bypass transport apparatus 5 in, as image recording apparatuses provided with a discharge storage tray, an image recording apparatus that is already operating as a stand-alone device from which the discharge storage tray has been removed, an image recording apparatus that is a new product, or the like. Accordingly, a stand-alone device that is already operating can be systemized as an image recording system, and it is possible to achieve an improvement in the properties of such a stand-alone device that is already operating with low cost.

Also, the above image recording system is configured with two image recording apparatuses, namely the color image recording apparatus 1 and the monochrome image recording apparatus 2, and four recording paper storage trays are provided in the color image recording apparatus 1 and the monochrome image recording apparatus 2, respectively. Accordingly, by using these four recording paper storage trays, it is possible to achieve an increase in the amount of recording paper compared to a case on which only one recording paper storage tray is provided.

Also, with the above image recording system, the bypass transport apparatus 5, which transports recording paper P that has been recorded with the monochrome image recording apparatus 2 to the final processing apparatus 3, is provided such that it crosses over the top of the color image recording apparatus 1 disposed in front of the monochrome image recording apparatus 2, and the top face portion of the case of the bypass transport apparatus 5 can be opened upward. Thus, by opening the top face portion of the case of the bypass transport apparatus 5 upward, it is possible to easily visually confirm the state of the bypass horizontal transport path 72 in the bypass transport apparatus 5. Accordingly, when recording paper P that has been recorded by the monochrome image recording apparatus 2 is transported by the bypass transport apparatus 5, even if trouble such as a jam occurs, it is possible to easily deal with such trouble.

Also, in the above image recording system, the top storage transport path 78 provided such that it branches from the bypass horizontal transport path 72, and the top storage tray 77, are provided on top of the bypass transport apparatus 5. Thus, the top storage tray 77 can be used along with the final processing apparatus 3, and as described above, recording paper P that has been recorded with the color image recording apparatus 1 can be stored in the first storage tray 86 of the final processing apparatus 3, and recording paper P that has been recorded with the monochrome image recording apparatus 2 can be stored in the top storage tray 77. Accordingly, when two jobs are processed in parallel using two image recording apparatuses, namely the color image recording apparatus 1 and the monochrome image recording apparatus 2, recording paper P that has been recorded with these image recording apparatuses, for each job unit, can be stored distinguishing between the final processing apparatus 3 and the top storage tray 77.

Also, in the above image recording system, it is possible to control the transport of recording P that is transported by the bypass horizontal transport path 72 of the bypass transport apparatus 5 provided in the color image recording apparatus 1, such that it is possible to temporarily hold the recording paper P in the bypass horizontal transport path 72. Thus, as described above, in the main transport path merging midway portion 76 of the bypass transport apparatus 5, it is possible to avoid collisions between recording paper P that has been recorded by the color image recording apparatus 1 and recording paper P that has been recorded by the monochrome image recording apparatus 2. Accordingly, for example, when a single job is processed dispersed between the color image recording apparatus 1 and the monochrome image recording apparatus 2, recording paper P that has been recorded by these two image recording apparatuses and discharged can be smoothly stored in the final processing apparatus 3.

Also, in the above image recording system, the color image reading apparatus 4 is installed on top of the monochrome image recording apparatus 2, and by adopting such a configuration, it is possible to add an image reading function to the above image recording system, so that it is possible to achieve high functionality. Also, along with being able to effectively use the space on top of the monochrome image recording apparatus 2, it is possible to open the color image reading apparatus 4 upward on top of the monochrome image recording apparatus 4. Accordingly, it is easy to operate the color image recording apparatus 4, and an improvement in the operability of the color image recording apparatus 4.

Also, in the above image recording system, the first maintenance space 111 is formed that is faced by both the second vertical transport path 54 of the color image recording apparatus 1 and the third vertical transport path 155 of the monochrome image recording apparatus 2, and so it is possible to use the first maintenance space 111 as a space for dealing with both jams of recording paper P that occur in the second vertical transport path 54 of the color image recording apparatus 1 and jams of recording paper P that occur in the third vertical transport path 155 of the monochrome image recording apparatus 2. Accordingly, it is possible to easily deal with jams of recording paper P that occur in the second vertical transport path 54 of the color image recording apparatus 1 or the third vertical transport path 155 of the monochrome image recording apparatus 2.

Likewise, the second maintenance space 112 faced by the third vertical transport path 55 of the color image recording apparatus 1 is formed, and so t is possible to use the second maintenance space 112 as a space for dealing with jams of recording paper P that occur in the third vertical transport path 55 of the color image recording apparatus 1. Accordingly, it is possible to easily deal with jams of recording paper P that occur in the third vertical transport path 55 of the color image recording apparatus 1.

Also, the double rear face door 101 is provided in the rear end face of the cabinet 100 of the above image recording system, the single side face rear door 102 is provided in both side faces of the rear end of the transport path connecting apparatus 6, and the single side face front door 103 is provided in both faces of the front end of the bypass transport path apparatus 5, and by using these doors, it is possible to easily perform maintenance work.

Also, when the rear face door 101, the side face rear door 102, or alternatively, the side face front door 103 is opened, the operation of the color image recording apparatus 1 and the monochrome image recording apparatus 2, that is, the image recording system, can be stopped. Accordingly, when performing maintenance work or the like of the above image recording system, it is possible to reliably stop operation of the image recording system, and maintenance work or the like can be safely performed.

In the image recording system in the above embodiment, the image recording system is configured using two image recording apparatuses, namely the color image recording apparatus 1 and the monochrome image recording apparatus 2, but by using the bypass transport apparatus 5, it is furthermore possible to increase the number of image forming apparatuses that configure the image recording system. For example, in the image recording system in the above embodiment, the bypass transport apparatus 5 is installed in the image recording apparatus to be added. By inserting the image recording apparatus to be added, in which the bypass transport apparatus 5 has been installed, between the final processing apparatus 3 of the image recording system of the above embodiment and the color image recording apparatus 1 in which the bypass transport apparatus 5 is installed, or between the color image recording apparatus 1 in which the bypass transport apparatus 5 is installed and the monochrome image recording apparatus 2, it is possible to form an image recording system that has been configured with three image recording apparatuses.

Either the color image recording apparatus 1 or the monochrome image recording apparatus 2 may be used as the image recording apparatus to be added. In these systems, when the image recording apparatus to be added, in which the bypass transport apparatus 5 has been installed, is inserted between the final processing apparatus 3 of the image recording system of the above embodiment and the color image recording apparatus 1 in which the bypass transport apparatus 5 is installed, recording paper P that has been recorded in the monochrome image recording apparatus 2 and the color image recording apparatus 1 is transported toward the final processing apparatus 3 by the bypass transport apparatus 5 that is installed in the inserted image recording apparatus.

Also, when the image recording apparatus to be added is inserted between the color image recording apparatus 1 in which the bypass transport apparatus 5 is installed in the above embodiment and the monochrome image recording apparatus 2, recording paper P that has been recorded with the monochrome image recording apparatus 2 is transported toward the final processing apparatus 3 by the bypass transport apparatus 5 that is installed in the inserted image recording apparatus, and the bypass transport apparatus 5 that is installed in the color image recording apparatus 1. Recording paper P that has been recorded with the added image recording apparatus is transported toward the final processing apparatus 3 by the bypass transport apparatus 5 that is installed in the color image recording apparatus 1. Also, in the same manner as described above, it is also possible to configure an image recording system provided with four or more image recording apparatuses.

Also, in the above image recording system, the single side face rear door 102 is provided in both side faces of the transport path connecting apparatus 6 of the cabinet 100, and the single side face front door 103 is provided in both faces of the front end of the bypass transport path apparatus 5, but the side face rear door 102 and the side face front door 103 may both be provided in any one of the side faces.

Also, the above image recording system is a compound system provided with all of the functions possessed by a copy machine and a print apparatus, but by providing this compound system with a connection interface to a telephone line and a fax control function, it can be made a compound system that is also provided with a fax function.

Figure 12:
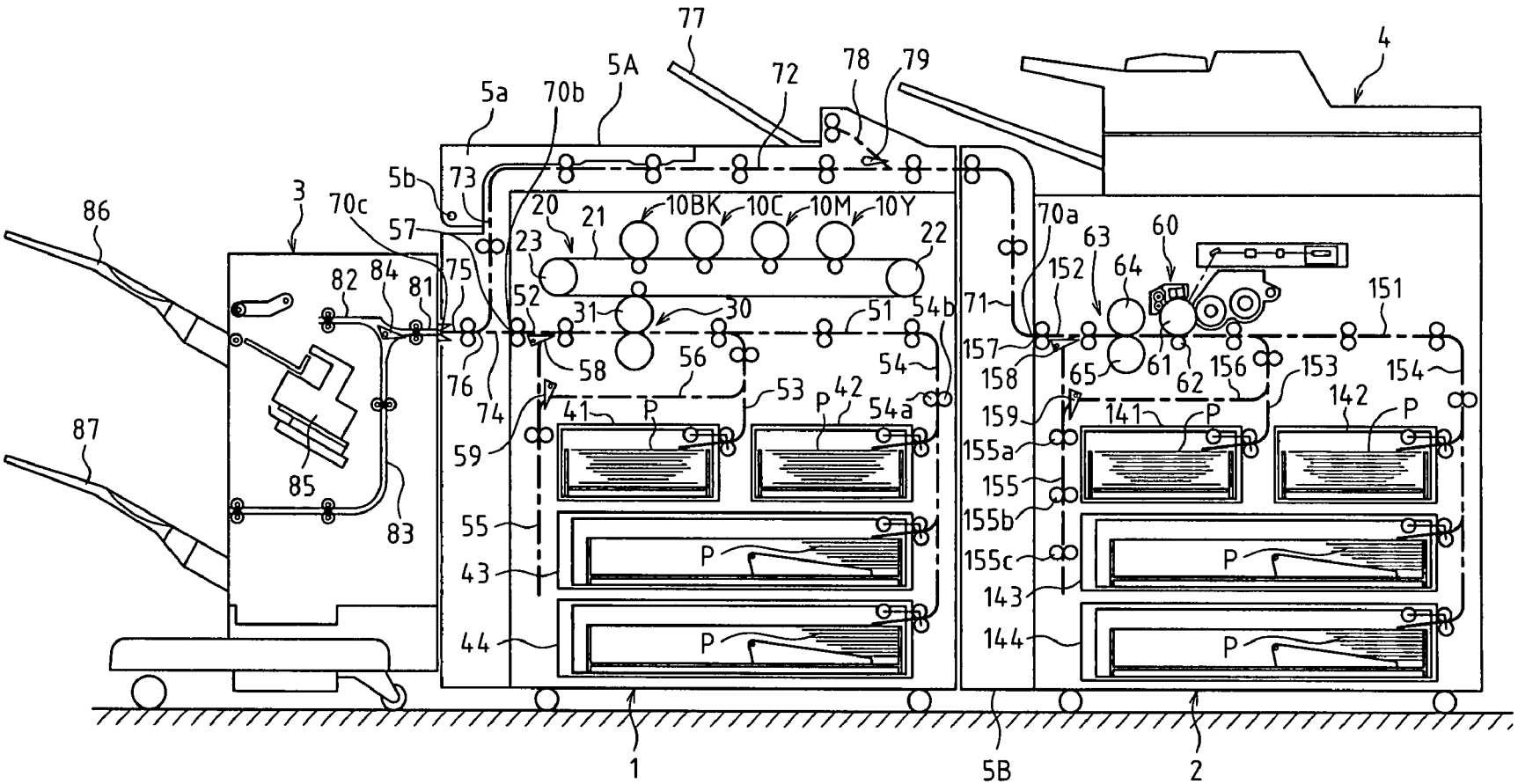
FIG. 12 is a configuration diagram of an image recording system in which a front bypass transport apparatus and a rear bypass transport apparatus are used.

In the image recording system in the above embodiment, the bypass transport apparatus 5 is formed in a single body, as shown in FIG. 9, and installed on top of the color image recording apparatus 1 such that it covers the color image recording apparatus 1, but a configuration can also be adopted in which the bypass transport apparatus 5 is divided into two portions, and the bypass transport apparatus 5 is installed with these portions that have been divided into two distributed to the color image recording apparatus 1 and the monochrome image recording apparatus 2. FIG. 12 shows the configuration of a color image recording apparatus that has been configured using this sort of method.

That is, the bypass transport apparatus 5 is divided into a rear bypass transport apparatus 5B, which is the portion in which the bypass ascending transport path 71 is formed, and a front bypass transport apparatus 5A, which is the portion in which the other portions are formed. Thus, because the bypass transport apparatus 5 is divided into the rear bypass transport apparatus 5B, which has a vertical plate-like shape, and the front bypass transport apparatus 5A, which has a reverse L-like shape, the rear bypass transport apparatus 5B with a vertical plate-like shape is installed in the front of the monochrome image recording apparatus 2, and the front bypass transport apparatus 5A with a reverse L-like shape is installed from the front to the top of the color image recording apparatus 1.

In addition, the final processing apparatus 3, the color image recording apparatus 1 in which the front bypass transport apparatus 5A has been installed, and the monochrome image recording apparatus in which the rear bypass transport apparatus 5B has been installed are disposed in a line in this order, forming the image recording system. In a image recording system that has been formed in this manner, same as the image recording system in the above embodiment, it is possible to obtain functionality and effectiveness.

The present invention may be embodied in various other forms without departing from the gist or essential characteristics thereof The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An image recording system comprising:

at least, an image recording apparatus that records an image on a recording medium, and a recording medium storage means that stores the recording medium that has been recorded by the image recording apparatus, wherein a plurality of the image recording apparatuses are disposed in a line in the direction from front to rear, and the recording medium storage means is shared by the plurality of image recording apparatuses and is provided at the head of the line, and the recording medium that has been recorded by one of said image recording apparatuses is discharged toward the recording medium storage means, and stored in the recording medium storage means; and a bypass transport apparatus provided for at least one of the image recording apparatuses wherein the bypass transport apparatus is distinct from the image recording apparatuses, wherein the recording medium that has been recorded by the image recording apparatus disposed to the rear of the image recording apparatus for which the bypass transport apparatus has been provided is discharged toward the recording medium storage means only via the bypass transport apparatus, and stored in the recording medium storage means, wherein:

the image recording apparatus positioned in front and adjacent front to rear is called a front apparatus, the image recording apparatus positioned to the rear and adjacent front to rear is called a rear apparatus, the lead front apparatus is called a lead apparatus, and the rearmost rear apparatus is called a tail apparatus, the image recording apparatuses are provided with an apparatus discharge port that discharges the recording medium for which recording is finished toward the front, and the bypass transport apparatus is provided for a main apparatus, which is an image recording apparatus other than the tail apparatus, and the bypass transport apparatus comprises:

a bypass front receiving port that is joined to the apparatus discharge port of the main apparatus for which the bypass transport apparatus has been installed and receives the recording medium that is discharged from the apparatus discharge port of the main apparatus, a main transport path that transports the recording medium that has been received in the bypass front receiving port toward the front, a bypass discharge port that discharges the recording medium that has been transported in the main transport path toward the front, a bypass rear receiving port that, when the rear apparatus of the main apparatus is the tail apparatus, is joined to the apparatus discharge port of the tail apparatus, and when not the tail apparatus, is joined to the bypass discharge port of the bypass transport apparatus installed for the rear apparatus of the main apparatus, and receives the recording medium that has been discharged from the bypass discharge port or the apparatus discharge port of the tail apparatus, and a bypass transport path that transports the recording medium that has been received in the bypass rear receiving port toward the front and merges with a midway portion of the main transport path, and the recording medium storage means that is shared by the image recording apparatuses is provided in the bypass discharge port of the bypass transport apparatus provided for the lead apparatus, wherein the bypass transport path of the bypass transport apparatus is provided such that it crosses over the top of the main apparatus, and the bypass transport path of the bypass transport apparatus is configured so that at least one portion can be opened upward; and further wherein the front apparatus and the rear apparatus, which are two image forming apparatuses, are adjacently disposed front to rear, and in both the front apparatus and the rear apparatus, a carry-out port path that transports the recording medium that has been carried out from a carry-out port that has been provided in rear of a recording medium storage portion that stores the recording medium, and a rear vertical transport path that is connected to the carry-out port path and transports the recording medium that has been transported through the carry-out port path upward, are provided in each rear portion of the front apparatus and the rear apparatus, and furthermore, the apparatus discharge port of a recording medium discharge port that discharges toward the front the recording medium that has been transported through a horizontal supply transport path continuing from the rear vertical transport path, then recorded in an image recording portion, and further transported toward the front through a horizontal discharge transport path, and a front vertical transport path that is a part of a transport path used when the recording medium that has been transported through the horizontal discharge transport path has its front and back reversed and then is returned to the horizontal supply transport path, are provided in each front portion of the front apparatus and the rear apparatus, and a first maintenance space, which is faced by both the rear vertical transport path of the front apparatus and the front vertical transport path of the rear apparatus, is formed in a portion below the bypass rear receiving port of the bypass transport apparatus, and in the rear vertical transport path of the front apparatus and the front vertical transport path of the rear apparatus, each side near the first maintenance space is moved inside the first maintenance space.

2. The image recording system according to claim 1, wherein the image recording apparatus is provided with a plurality of recording medium storage portions.

3. The image recording system according to claim 1, wherein by providing the recording medium storage means that stores the recording medium discharged from the apparatus discharge port in the apparatus discharge port, an image recording apparatus that can be independently used as a stand-alone device is used as an image recording apparatus.

4. The image recording system according claim 1, wherein the bypass transport apparatus can be installed for the main apparatus later.

5. The image recording system according to claim 1, wherein the bypass transport apparatus controls transport such that the recording medium that is transported in the bypass transport path of the bypass transport apparatus can be temporarily held in the bypass transport path.

6. The image recording system according to claim 1, wherein an image reading means is provided on top of the tail apparatus.

7. The image recording system according to claim 1, wherein the rear vertical transport path of the front apparatus and the front vertical transport path of the rear apparatus can both be opened to the first maintenance space.

8. The image recording system according to claim 7, wherein a cover that can be opened and closed is provided on at least one of both side faces of the first maintenance space, and when the cover is opened, both the front apparatus and the rear apparatus stop operation.

9. The image recording system according to claim 1, wherein a second maintenance space, which is faced by the front vertical transport path of the front apparatus, is formed in a portion below the main transport path of the bypass transport apparatus of the bypass transport portion.

10. The image recording system according to claim 9, wherein the front vertical transport path of the front apparatus can be opened to the second maintenance space.

11. The image recording system according to claim 10, wherein a cover that can be opened and closed is provided on at least one of both side faces of the second maintenance space, and when the cover is opened, both the front apparatus and the rear apparatus stop operation.

12. The image recording system according to claim 1, wherein a cover that can be opened and closed is provided in a portion where the rear face of the space in which the rear apparatus is stored opposes at least the rear vertical transport path of the rear apparatus, and when the cover is opened, both the front apparatus and the rear apparatus stop operation.

13. The image recording system according to claim 12, wherein when the cover is opened, the rear vertical transport path of the rear apparatus can be opened to the rear.

14. The image recording system according to claim 1, wherein a cover that can be opened and closed is provided in at least a portion of a side face of the bypass transport path of the bypass transport portion, and when the cover is opened, both the front apparatus and the rear apparatus stop operation.

15. The image recording system according to claim 1, wherein a cover that can be opened and closed is provided in at least a portion of a top face of the bypass transport path of the bypass transport portion, and when the cover is opened, both the front apparatus and the rear apparatus stop operation.

16. The image recording system according to claim 15, wherein when the cover is opened, at least a portion of the bypass transport path of the bypass transport portion can be opened upward.

17. The image recording system according to claim 1, wherein two of the plurality of image recording apparatuses have different processing speeds.

18. The image recording system according to claim 1, wherein two of the plurality of image recording apparatuses have different recording resolutions.

19. The image recording system according to claim 1, wherein two of the plurality of image recording apparatuses use different types of recording media.

20. The image recording system according to claim 1, wherein one of the plurality of image recording apparatuses is a color image recording apparatus, and another is a monochrome image recording apparatus.

21. An image recording system comprising:

at least, an image recording apparatus that records an image on a recording medium, and a recording medium storage means that stores the recording medium that has been recorded by the image recording apparatus, wherein a plurality of the image recording apparatuses are disposed in a line in the direction from front to rear, and the recording medium storage means is shared by the plurality of image recording apparatuses and is provided at the head of the line, and the recording medium that has been recorded by one of said image recording apparatuses is discharged toward the recording medium storage means, and stored in the recording medium storage means; and a bypass transport apparatus provided for at least one of the image recording apparatuses wherein the bypass transport apparatus is distinct from the image recording apparatuses, wherein the recording medium that has been recorded by the image recording apparatus disposed to the rear of the image recording apparatus for which the bypass transport apparatus has been provided is discharged toward the recording medium storage means only via the bypass transport apparatus, and stored in the recording medium storage means, wherein:

the image recording apparatus positioned in front and adjacent front to rear is called a front apparatus, the image recording apparatus positioned to the rear and adjacent front to rear is called a rear apparatus, the lead front apparatus is called a lead apparatus, and the rearmost rear apparatus is called a tail apparatus, the image recording apparatuses are provided with an apparatus discharge port that discharges the recording medium for which recording is finished toward the front, and the bypass transport apparatus is provided for a main apparatus, which is an image recording apparatus other than the tail apparatus, and the bypass transport apparatus comprises:

a bypass front receiving port that is joined to the apparatus discharge port of the main apparatus for which the bypass transport apparatus has been installed and receives the recording medium that is discharged from the apparatus discharge port of the main apparatus, a main transport path that transports the recording medium that has been received in the bypass front receiving port toward the front, a bypass discharge port that discharges the recording medium that has been transported in the main transport path toward the front, a bypass rear receiving port that, when the rear apparatus of the main apparatus is the tail apparatus, is joined to the apparatus discharge port of the tail apparatus, and when not the tail apparatus, is joined to the bypass discharge port of the bypass transport apparatus installed for the rear apparatus of the main apparatus, and receives the recording medium that has been discharged from the bypass discharge port or the apparatus discharge port of the tail apparatus, and a bypass transport path that transports the recording medium that has been received in the bypass rear receiving port toward the front and merges with a midway portion of the main transport path, and the recording medium storage means that is shared by the image recording apparatuses is provided in the bypass discharge port of the bypass transport apparatus provided for the lead apparatus, wherein the bypass transport path of the bypass transport apparatus is provided such that it crosses over the top of the main apparatus, and a top storage means, which branches from the bypass transport path and stores the recording medium that is discharged from the rear apparatus of the main apparatus and is transported by the bypass transport path of the bypass transport apparatus installed for the main apparatus, is installed on top of the bypass transport apparatus, and further wherein the front apparatus and the rear apparatus, which are two image forming apparatuses, are adjacently disposed front to rear, and in both the front apparatus and the rear apparatus, a carry-out port path that transports the recording medium that has been carried out from a carry-out port that has been provided in the rear of a recording medium storage portion that stores the recording medium, and a rear vertical transport path that is connected to the carry-out port path and transports the recording medium that has been transported through the carry-out port path upward, are provided in each rear portion of the front apparatus and the rear apparatus, and furthermore, the apparatus discharge port of a recording medium discharge port that discharges toward the front the recording medium that has been transported through a horizontal supply transport path continuing from the rear vertical transport path, then recorded in an image recording portion, and further transported toward the front through a horizontal discharge transport path, and a front vertical transport path that is a part of a transport path used when the recording medium that has been transported through the horizontal discharge transport path has its front and back reversed and then is returned to the horizontal supply transport path, are provided in each front portion of the front apparatus and the rear apparatus, and a first maintenance space, which is faced by both the rear vertical transport path of the front apparatus and the front vertical transport path of the rear apparatus, is formed in a portion below the bypass rear receiving port of the bypass transport apparatus, and in the rear vertical transport path of the front apparatus and the front vertical transport path of the rear apparatus, each side near the first maintenance space is moved inside the first maintenance space.

22. An image recording system, comprising:

a front apparatus and a rear apparatus, which are two image forming apparatuses, adjacently disposed front to rear, and in both the front apparatus and the rear apparatus, a carry-out port path that transports a recording medium that has been carried out from a carry-out port that has been provided in the rear of a recording medium storage portion that stores the recording medium, and a rear vertical transport path that is connected to the carry-out port path and transports the recording medium that has been transported through the carry-out port path upward, are provided in each rear portion of the front apparatus and the rear apparatus, an apparatus discharge port of a recording medium discharge port that discharges toward the front the recording medium that has been transported through a horizontal supply transport path continuing from the rear vertical transport path, then recorded in an image recording portion, and further transported toward the front through a horizontal discharge transport path, and a front vertical transport path that is a part of a transport path used when the recording medium that has been transported through the horizontal discharge transport path has its front and back reversed and then is returned to the horizontal supply transport path, are provided in each front portion of the front apparatus and the rear apparatus, a bypass transport apparatus, comprising;

a bypass front receiving port that is joined to the apparatus discharge port of the front apparatus, a bypass rear receiving port that is joined to the apparatus discharge port of the rear apparatus and receives the recording medium that has been discharged from the apparatus discharge port of the rear apparatus, a bypass transport path that transports the recording medium that has been received in the bypass rear receiving port toward the front, and a first maintenance space, which is faced by both the rear vertical transport path of the front apparatus and the front vertical transport path of the rear apparatus, is formed in a portion below the bypass rear receiving port of the bypass transport apparatus, and in the rear vertical transport path of the front apparatus and the front vertical transport path of the rear apparatus, each side near the first maintenance space is moved inside the first maintenance space.

* * * * *